US012434133B2

(12) United States Patent
Song

(10) Patent No.: US 12,434,133 B2
(45) Date of Patent: Oct. 7, 2025

(54) PICKAGRAM THREE-DIMENSIONAL PUZZLE

(71) Applicant: Gil Ryong Song, Gimpo-si (KR)

(72) Inventor: Gil Ryong Song, Gimpo-si (KR)

( * ) Notice: Subject to any disclaimer, the term of this patent is extended or adjusted under 35 U.S.C. 154(b) by 0 days.

(21) Appl. No.: 18/240,398

(22) Filed: Aug. 31, 2023

(65) Prior Publication Data

US 2023/0405450 A1 Dec. 21, 2023

Related U.S. Application Data

(63) Continuation of application No. PCT/KR2022/001985, filed on Feb. 9, 2022.

(30) Foreign Application Priority Data

Mar. 5, 2021 (KR) ..... 10-2021-0029735
Feb. 9, 2022 (KR) ..... 10-2022-0016916

(51) Int. Cl.
*A63F 9/12* (2006.01)

(52) U.S. Cl.
CPC ..... *A63F 9/12* (2013.01); *A63F 2009/1212* (2013.01)

(58) Field of Classification Search
CPC .. A63F 9/12; A63F 2009/1212; A63F 9/1208; A63H 33/046
See application file for complete search history.

(56) References Cited

U.S. PATENT DOCUMENTS 1,236,234 A * 8/1917 Troje ..... A63H 33/046 403/DIG. 1
1,578,225 A * 3/1926 White ..... G09B 1/40 434/238
2,216,915 A * 10/1940 Johnson ..... A63F 9/12 273/157 R
4,522,404 A * 6/1985 Di Gregorio ..... A63H 33/04 446/124
4,753,622 A * 6/1988 Nakama ..... A63H 33/04 446/85

(Continued)

FOREIGN PATENT DOCUMENTS

CN 105582668 A * 5/2016
CN 208525824 U * 2/2019

(Continued)

*Primary Examiner* — Steven B Wong
(74) *Attorney, Agent, or Firm* — Carlson, Gaskey & Olds, P.C.

(57) ABSTRACT

A pickagram three-dimensional puzzle comprises seven 3D blocks and a plurality of magnetic members located inside each 3D block to couple the neighboring 3D blocks to one another through magnetic forces generated therefrom. A first 3D block of the seven 3D blocks has the shape of a right triangle on a plane and include a first top face, a first bottom face located to be opposite to the first top face, a first lateral face for connecting the boundary edges of the first top face and the boundary edges of the first bottom face to one another, and a plurality of accommodation pipes arranged along the first lateral face, and the plurality of magnetic members include a plurality of first magnetic members located correspondingly inside the plurality of accommodation pipes.

7 Claims, 18 Drawing Sheets

(56) References Cited

U.S. PATENT DOCUMENTS

| | | | | | |
|---|---|---|---|---|---|
| 5,580,056 | A * | 12/1996 | Clark | A63F 9/12 | D21/504 |
| 5,746,638 | A * | 5/1998 | Shiraishi | A63H 33/046 | 446/131 |
| 6,145,837 | A * | 11/2000 | Silvey | A63F 9/12 | 273/157 R |
| D739,896 | S * | 9/2015 | Peker | D21/479 | |
| 9,873,062 | B2 * | 1/2018 | Purns | A63H 33/06 | |
| 11,103,801 | B2 * | 8/2021 | Vicentelli | A63H 33/06 | |
| 11,458,410 | B2 * | 10/2022 | Xu | A63H 33/046 | |
| D991,362 | S | 7/2023 | Song et al. | | |
| 11,766,622 | B1 * | 9/2023 | Chen | A63H 33/046 | 446/92 |
| 2011/0037223 | A1 * | 2/2011 | Burton | A63H 33/046 | 273/157 R |
| 2015/0258462 | A1 * | 9/2015 | Wei | A63H 33/06 | 446/92 |
| 2017/0232357 | A1 * | 8/2017 | Rosen | A63H 33/046 | 446/92 |
| 2019/0201804 | A1 * | 7/2019 | Khalus | A63H 33/046 | |
| 2020/0215426 | A1 * | 7/2020 | Kuo | A63F 9/001 | |
| 2020/0406156 | A1 * | 12/2020 | Rosen | A63H 33/042 | |
| 2022/0016539 | A1 * | 1/2022 | Zhang | A63H 33/046 | |
| 2024/0075399 | A1 * | 3/2024 | Hsu | A63H 33/046 | |

FOREIGN PATENT DOCUMENTS

| | | | | |
|---|---|---|---|---|
| CN | 110841307 | A * | 2/2020 | |
| CN | 215387501 | U * | 1/2022 | |
| CN | 221181656 | U * | 6/2024 | |
| CN | 221286864 | U * | 7/2024 | |
| DE | 202008013603 | U1 * | 1/2009 | A63F 9/12 |
| KR | 454067 | Y1 * | 6/2011 | A63F 9/12 |
| KR | 20190084709 | A * | 7/2019 | |

* cited by examiner

PICKAGRAM THREE-DIMENSIONAL PUZZLE

CROSS-REFERENCE TO RELATED APPLICATION

The present application is a continuation of International Application No. PCT/KR2022/001985 filed on Feb. 9, 2022, which claims priority under 35 U.S.C. § 119(a) to Korean Patent Application No. 10-2021-0029735 filed in the Korean Intellectual Property Office on Mar. 5, 2021 and Korean Patent 10-2022-0016916, filed in the Korean Intellectual Property Office on Feb. 9, 2022, the entire disclosure of which is incorporated herein by reference.

TECHNICAL FIELD

The present disclosure relates to a pickagram that is a three-dimensional (3D) puzzle, more specifically to a pickagram three-dimensional puzzle that is capable of allowing a user to create various 3D figures through the combination of seven blocks.

BACKGROUND ART

Tangram is a puzzle consisting of seven flat pieces, which are put together to form specific shapes. In specific, the tangram is a toy made of a square divided into seven pieces that can be arranged to create various figures, symbols, numbers, shapes of objects, and the like, which is known to be very effective in developing the children's creativity and spatial perception. The tangram has been introduced even in current elementary school curriculum.

Generally, the tangram puzzle set consists of seven flat pieces made of wood, plastic, paper, and the like. Through the application of the tangram puzzle, further, puzzle sets consisting of seven or more blocks are well known. For example, tangram sets consisting of ten pieces or twelve pieces are known.

SUMMARY

Disclosure

Technical Problem

Accordingly, the present disclosure has been made in view of the above-mentioned problems occurring in the related art, and it is an object of the present disclosure to provide a pickagram three-dimensional puzzle that is capable of allowing a user to create various 3D figures through the combination of seven 3D blocks.

It is another object of the present disclosure to provide a pickagram three-dimensional puzzle that is capable of developing a user's creativity and providing a lot of fun for the user.

The technical problems to be achieved through the present disclosure are not limited as mentioned above, and other technical problems not mentioned herein will be obviously understood by one of ordinary skill in the art through the following description.

Technical Solution

To accomplish the above-mentioned objects, according to the present disclosure, a pickagram three-dimensional puzzle may include seven 3D blocks and a plurality of magnetic members located inside each 3D block to couple the neighboring 3D blocks to one another through magnetic forces generated therefrom, wherein a first 3D block of the seven 3D blocks has the shape of a right triangle on a plane and include a first top face, a first bottom face located to be opposite to the first top face, a first lateral face for connecting the boundary edges of the first top face and the boundary edges of the first bottom face to one another, and a plurality of first accommodation pipes arranged along the first lateral face inside, and the plurality of magnetic members include a plurality of first magnetic members located correspondingly inside the plurality of first accommodation pipes.

Detailed explanations of the embodiments of the present disclosures will be given in the following description with respect to the attached drawings.

Effectiveness of Disclosure

According to the present disclosure, the pickagram three-dimensional puzzle allows the user to create various 3D figures through the combination of the seven 3D blocks. Further, the pickagram three-dimensional puzzle according to the present disclosure develops the user's creativity and provides a lot of fun to him or her while he or she is creating various 3D figures.

The effectiveness of the disclosure is not limited as mentioned above, and it should be understood to those skilled in the art that the effectiveness of the disclosure may include another effectiveness as not mentioned above from the detailed description of the present disclosure.

DETAILED DESCRIPTION

Hereinafter, an explanation of an embodiment of the present disclosure will be given in detail with reference to the attached drawings.

Figure 1:
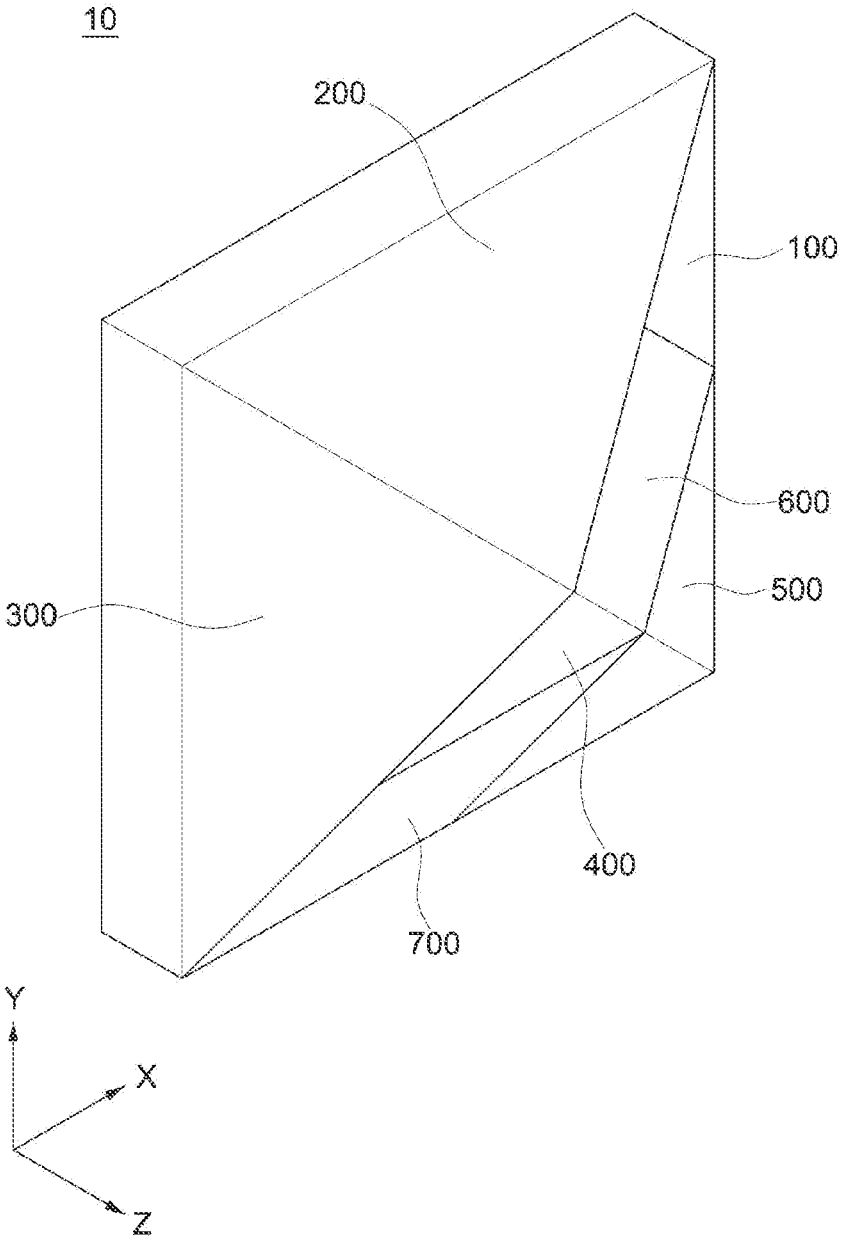
FIG. 1 is a perspective view showing a pickagram three-dimensional puzzle according to the present disclosure.
Figure 2:
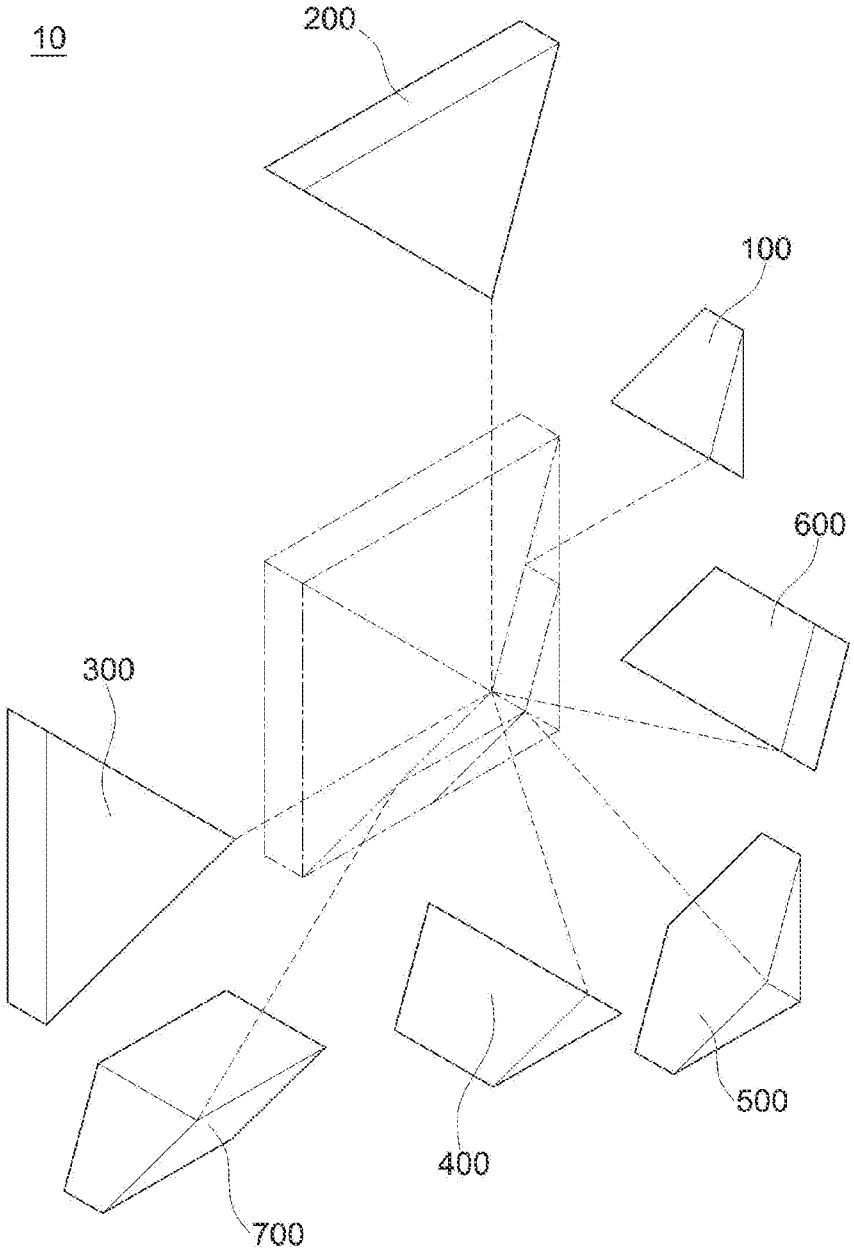
FIG. 2 is an exploded perspective view showing the pickagram three-dimensional puzzle of FIG. 1.
Figure 3A:
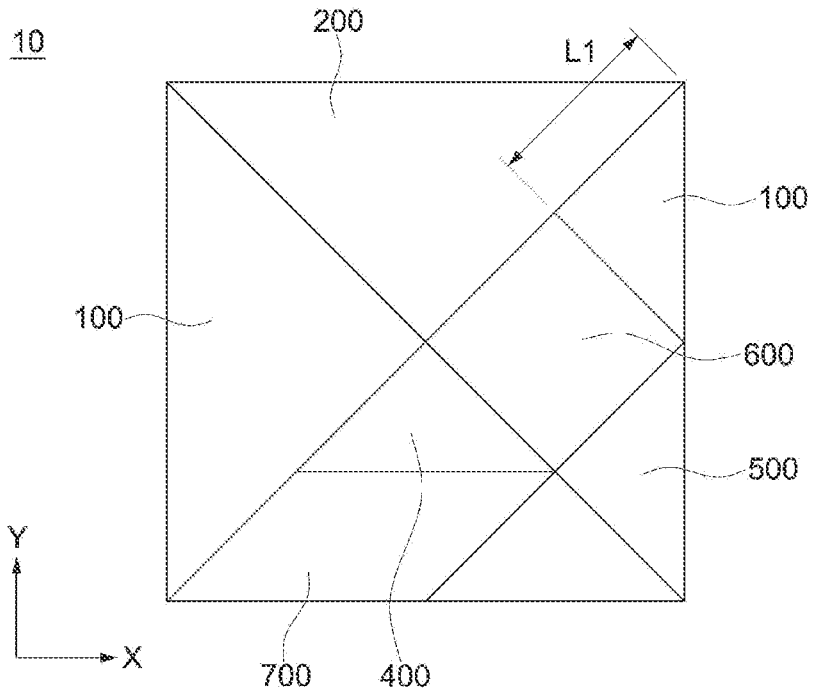
FIGS. 3A and 3B show the pickagram three-dimensional puzzle of FIG. 1.
Figure 3B:
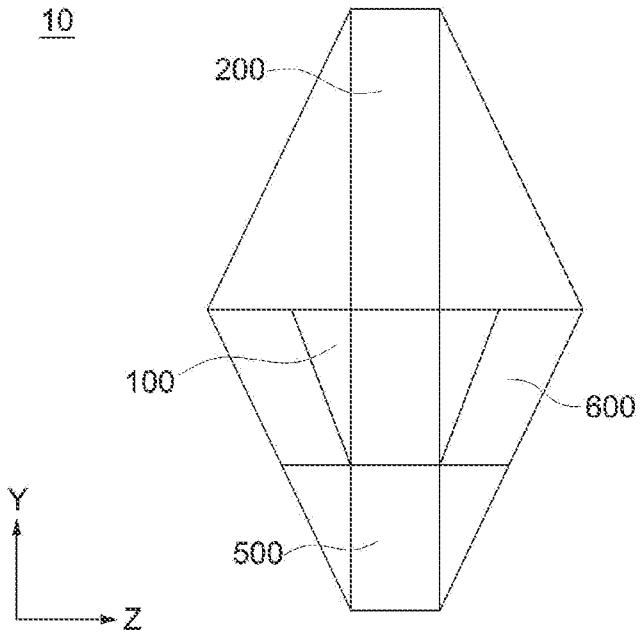
Figure 4A:
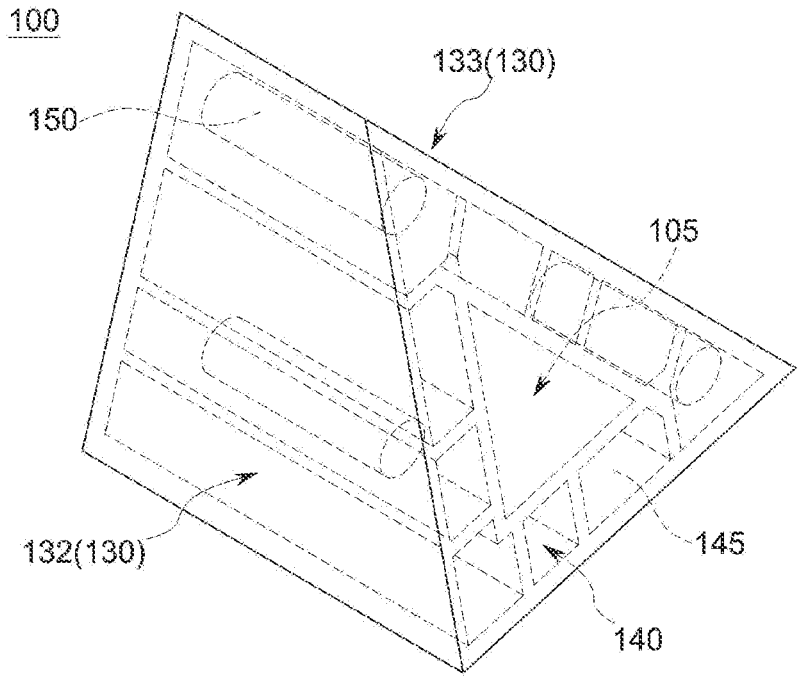
FIGS. 4A, 4B, 5A, and 5B show a first 3D block constituting the pickagram three-dimensional puzzle of FIG. 1.
Figure 4B:
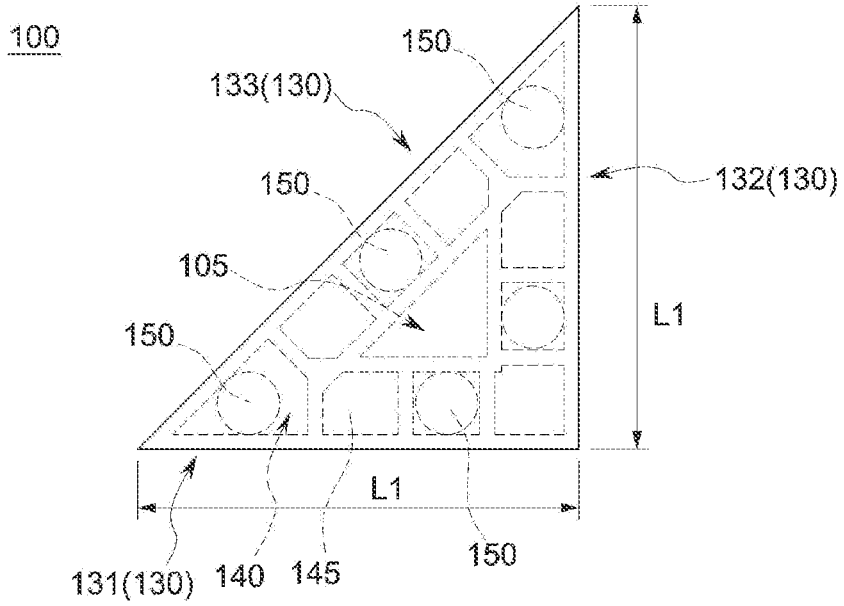
Figure 5A:
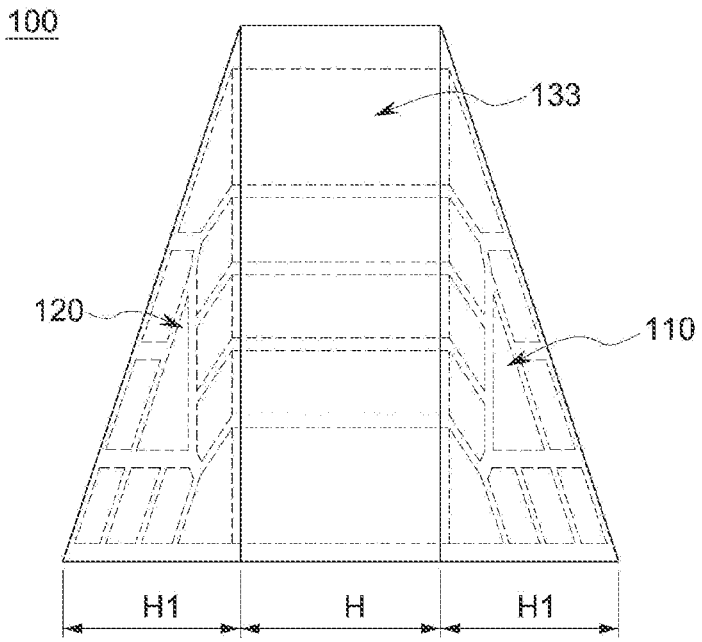
Figure 5B:
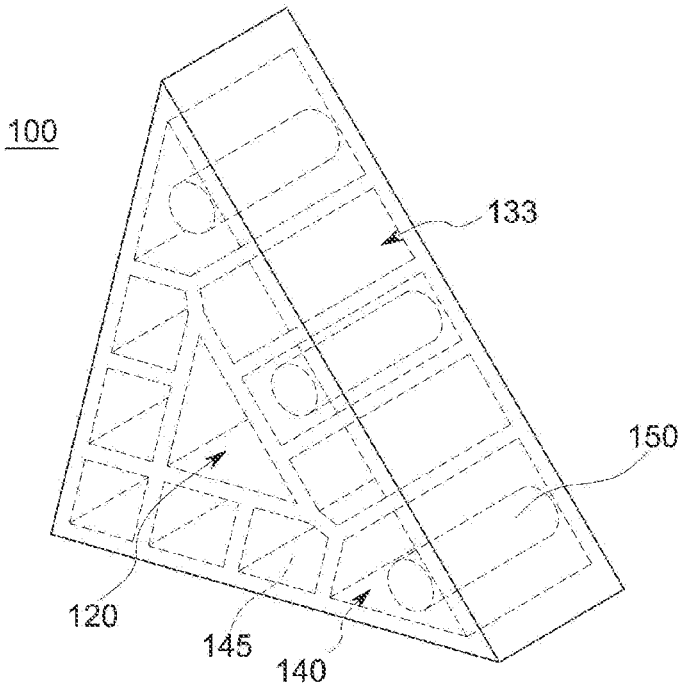

FIG. 1 is a perspective view showing a pickagram three-dimensional puzzle according to the present disclosure, FIG. 2 is an exploded perspective view showing the pickagram three-dimensional puzzle of FIG. 1, and FIGS. 3A and 3B show the pickagram three-dimensional puzzle of FIG. 1.

Referring to FIGS. 1 to 3A and 3B, a pickagram three-dimensional puzzle 10 according to an embodiment of the present disclosure provides specific 3D figures through the combinations of seven 3D blocks. The pickagram three-dimensional puzzle 10 consists of the seven 3D blocks with given 3D shapes and a plurality of magnetic members located inside each 3D block to couple the neighboring 3D blocks to one another through magnetic forces generated therefrom. In the embodiment of the present disclosure, each magnetic member has an N-pole at one side thereof and an S-pole at the other side thereof with respect to a longitudinal direction thereof.

In the embodiment of the present disclosure, the pickagram three-dimensional puzzle 10 with the seven 3D blocks is three-dimensional to a shape of a rectangular parallelepiped having two square horns symmetrically arranged, but the pickagram three-dimensional puzzle 10 may not be limited thereto.

Each 3D block has a five or more-faced shape. The seven 3D blocks include a first 3D block 100, a second 3D block 200, a third 3D block 300, a fourth 3D block 400, a fifth 3D block 500, a sixth 3D block 600, and a seventh 3D block 700.

The first 3D block 100 has the shape of an isosceles right triangle on a plane. The two sides of equal length of the first 3D block 100 are defined as each having a first length L1. The first 3D block 100 is three-dimensionally shaped.

Figure 6A:
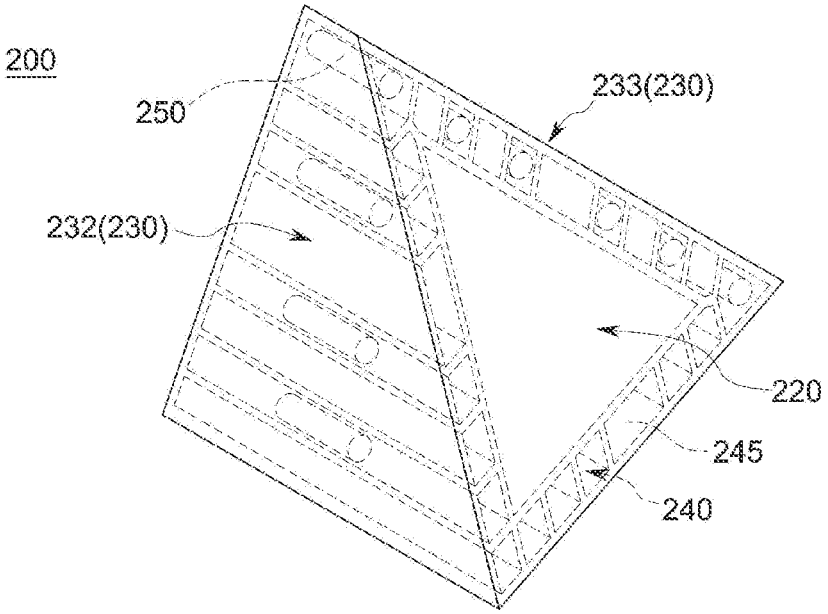
FIGS. 6A, 6B, 7A, and 7B show a second 3D block constituting the pickagram three-dimensional puzzle of FIG. 1.
Figure 6B:
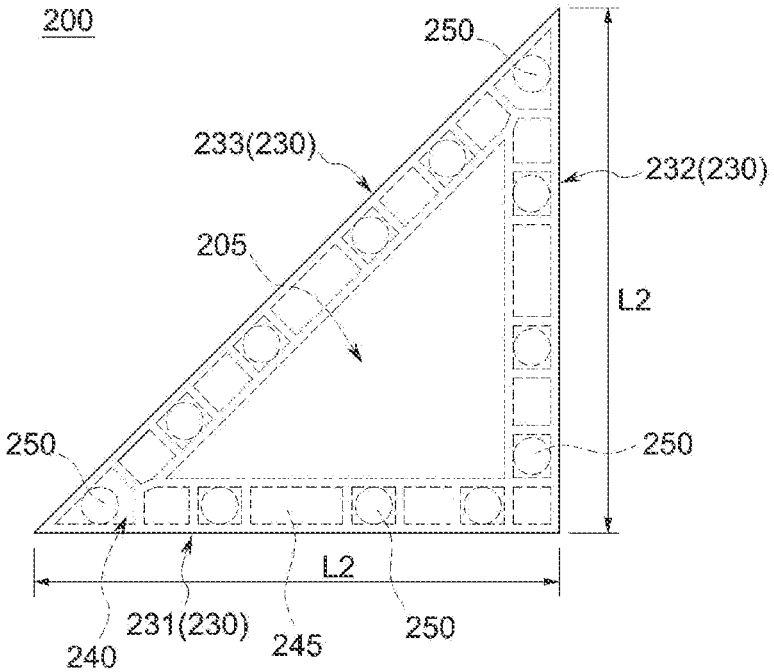
Figure 7A:
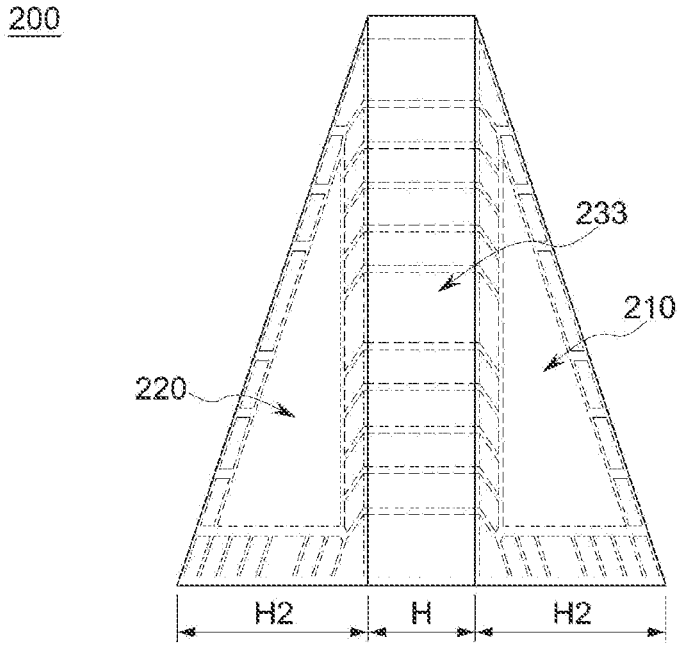
Figure 7B:
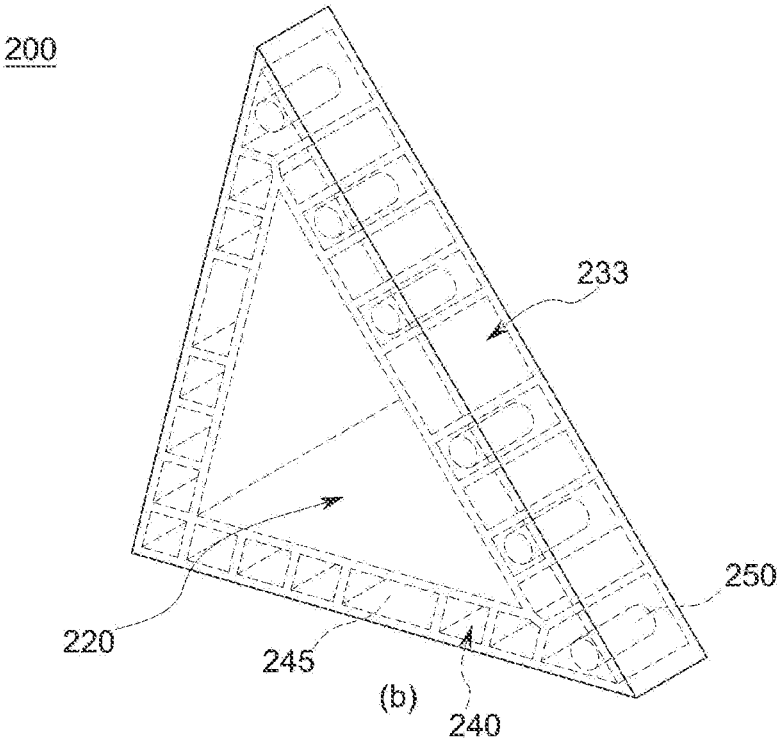

The second 3D block 200 has the shape of an isosceles right triangle on a plane. The two sides of equal length of the second 3D block 200 are defined as each having a second length L2 (See FIG. 6B). The second length L2 is two times longer than the first length L1.

Figure 8A:
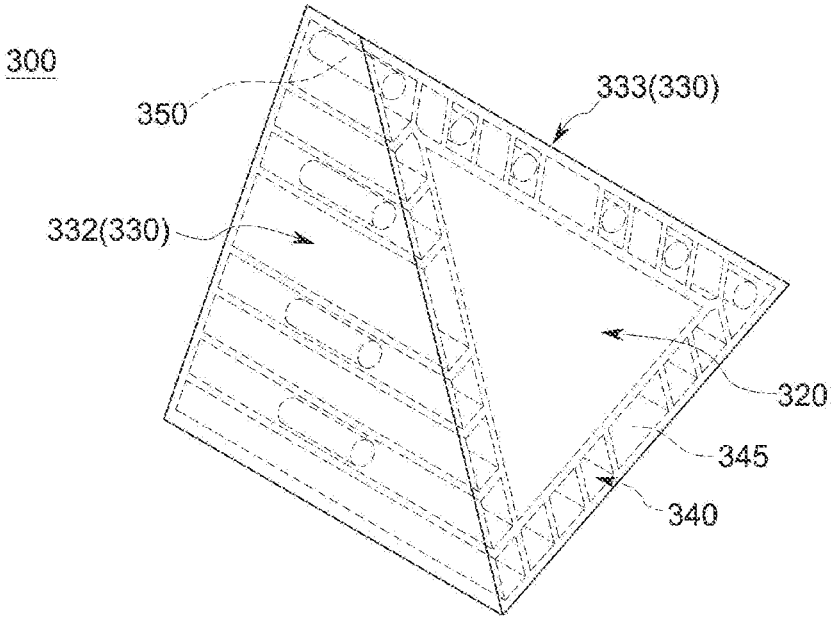
FIGS. 8A, 8B, 9A, and 9B show a third 3D block constituting the pickagram three-dimensional puzzle of FIG. 1.
Figure 8B:
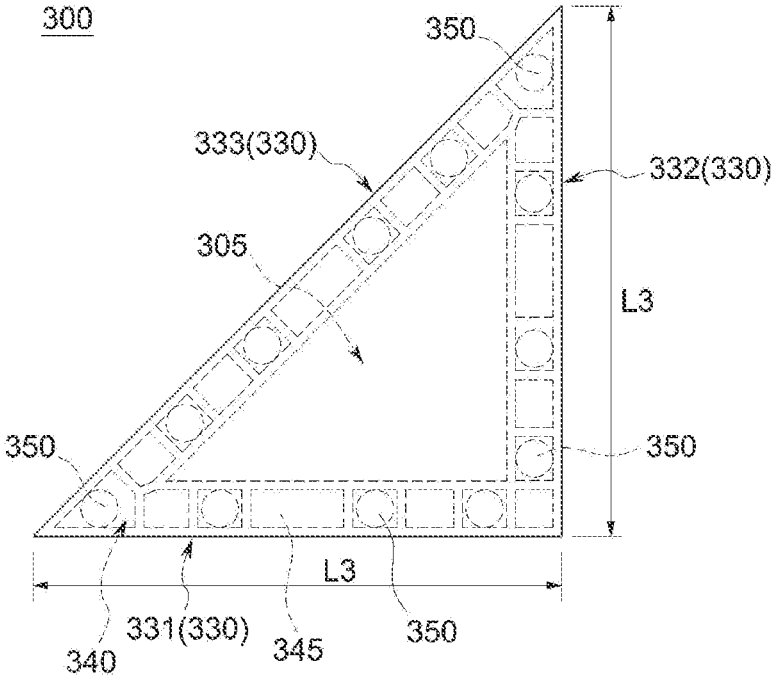
Figure 9A:
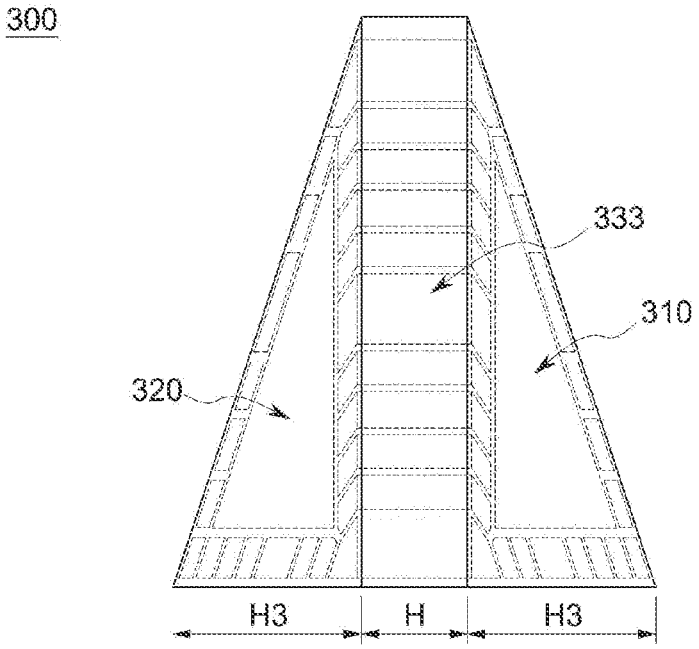
Figure 9B:
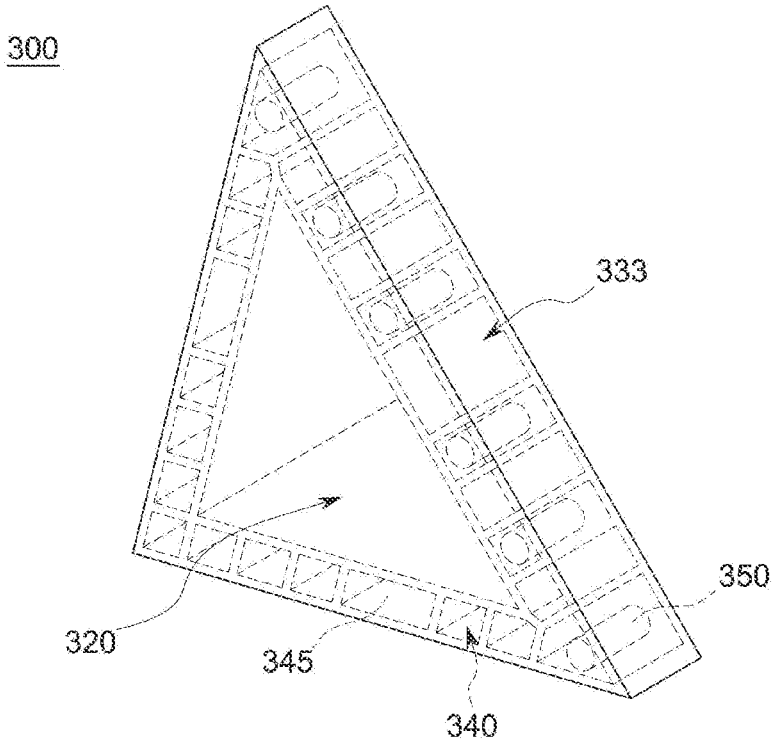

The third 3D block 300 has the shape of an isosceles right triangle on a plane. The two sides of equal length of the third 3D block 300 are defined as each having a third length L3 (See FIG. 8B). The third length L3 is equal to the second length L2. Further, the third length L3 is two times longer than the first length L1.

Figure 10A:
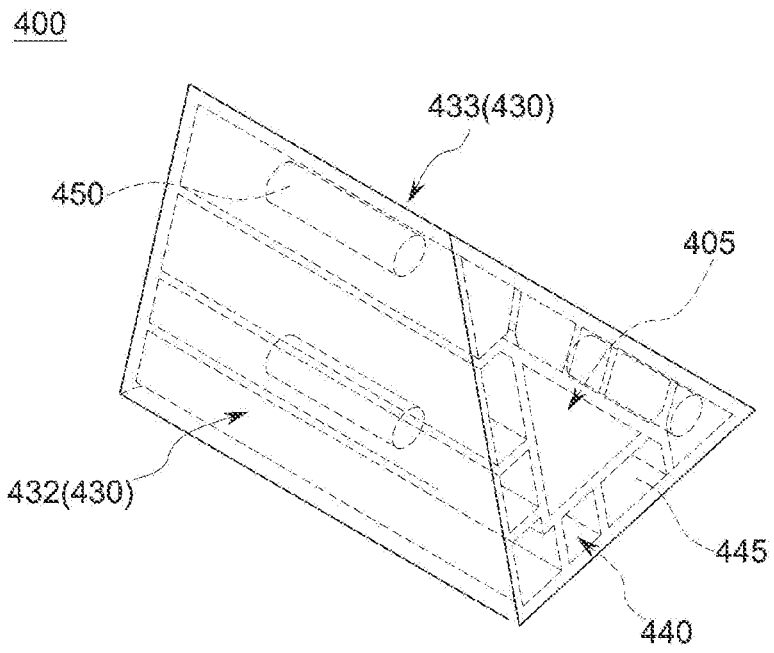
FIGS. 10A, 10B, 11A, and 11B show a fourth 3D block constituting the pickagram three-dimensional puzzle of FIG. 1.
Figure 10B:
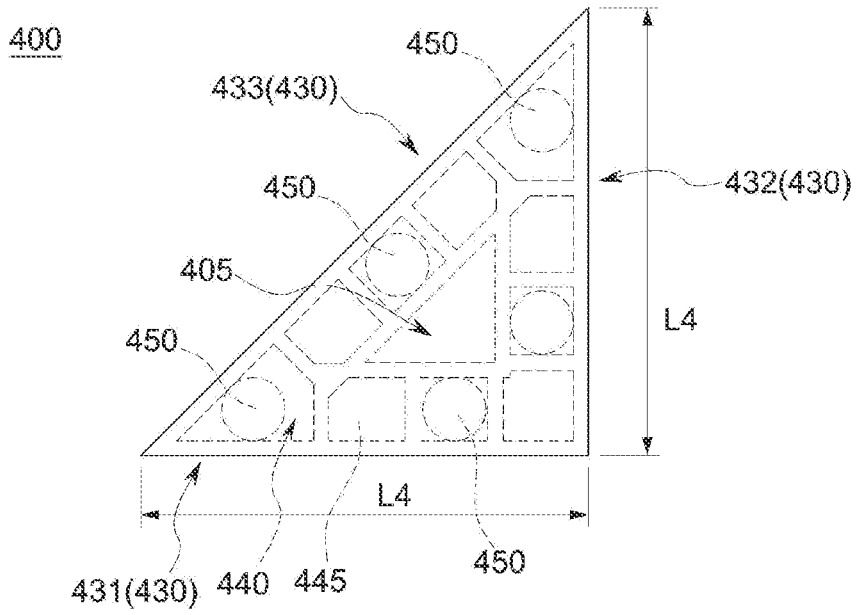
Figure 11A:
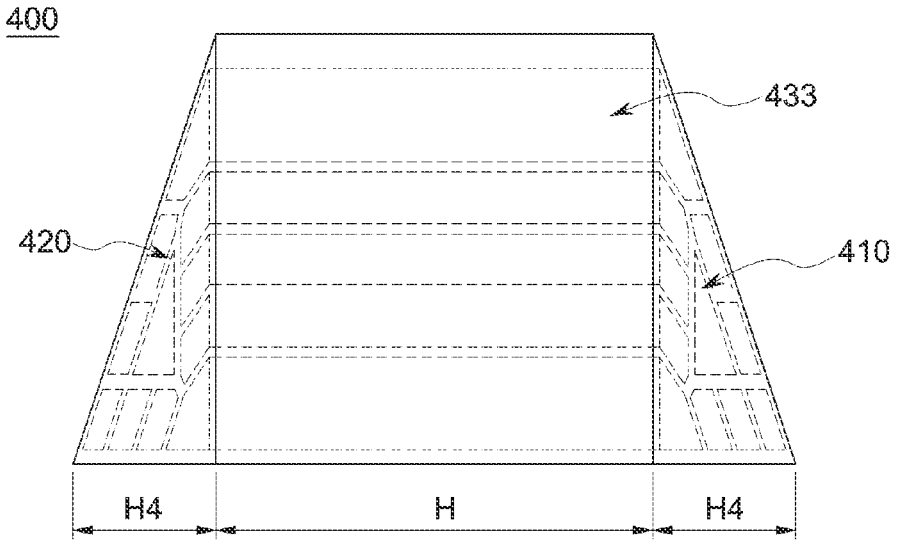
Figure 11B:
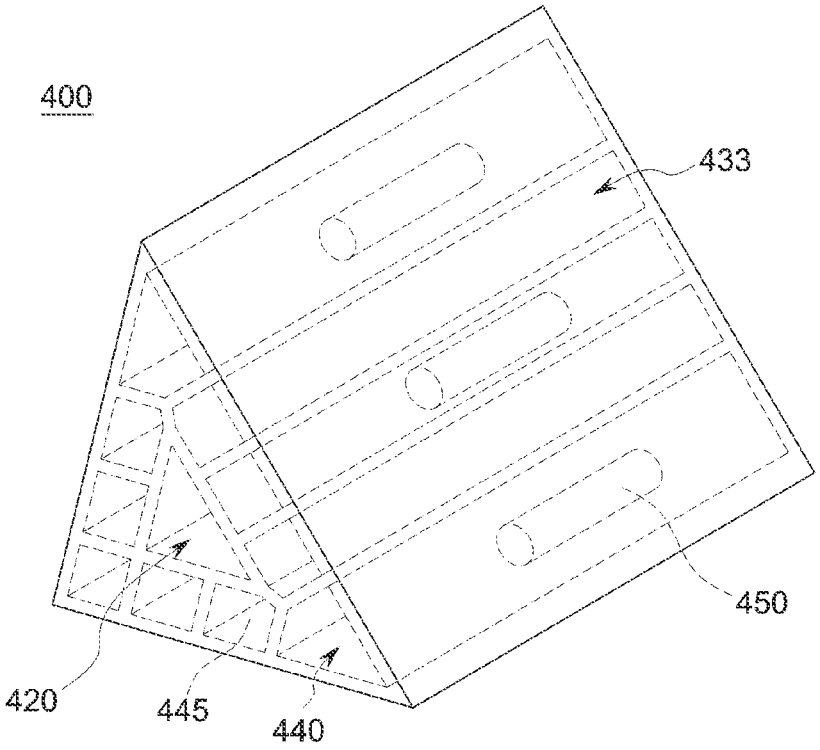

The fourth 3D block 400 has the shape of an isosceles right triangle on a plane. The two sides of equal length of the fourth 3D block 400 are defined as each having a fourth length L4 (See FIG. 10B). The fourth length L4 is equal to the first length L1.

Figure 12A:
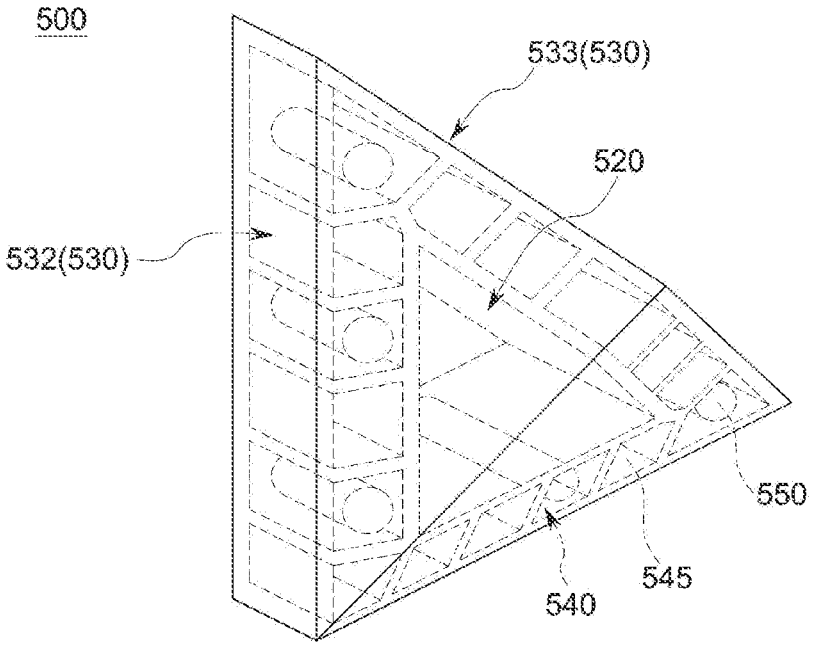
FIGS. 12A, 12B, 13A, and 13B show a fifth 3D block constituting the pickagram three-dimensional puzzle of FIG. 1.
Figure 12B:
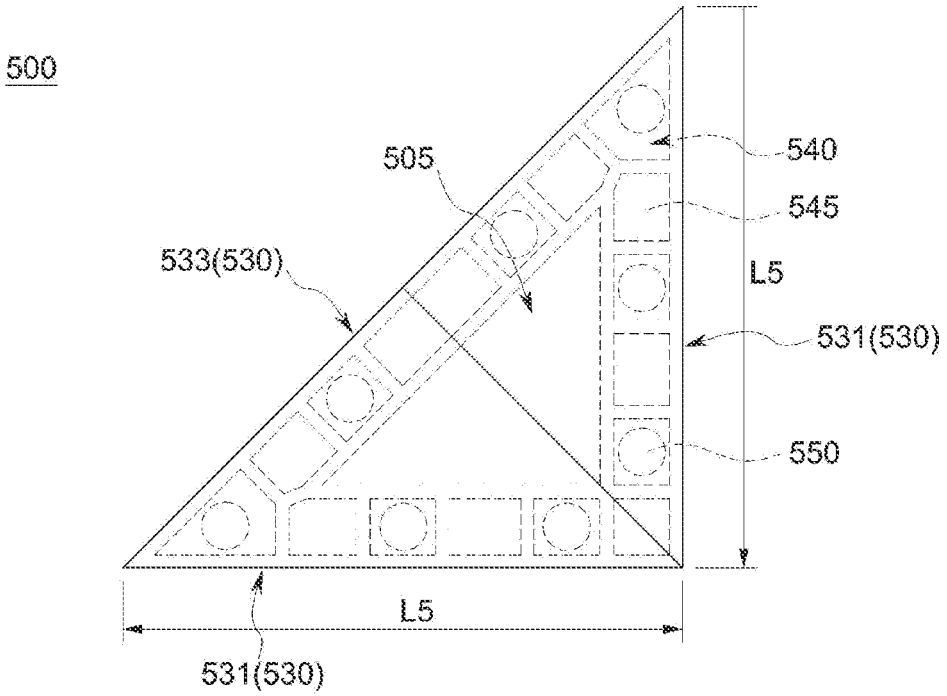
Figure 13A:
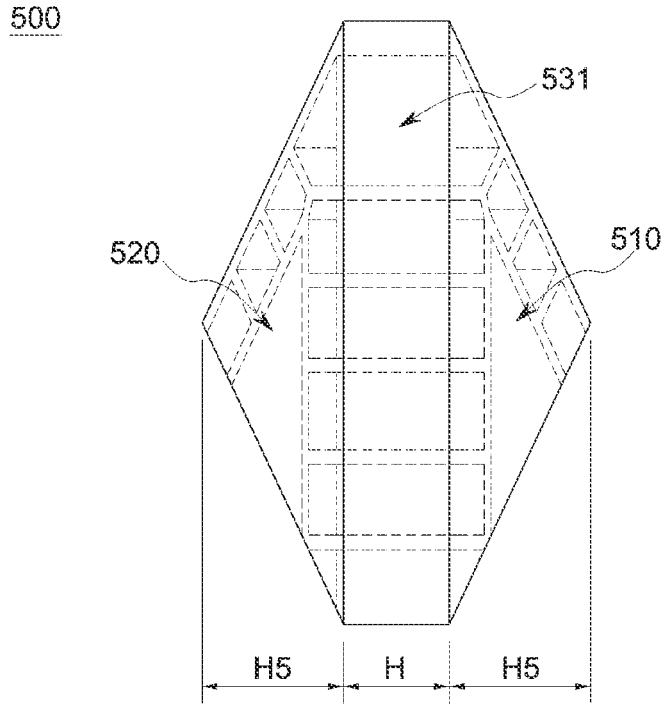
Figure 13B:
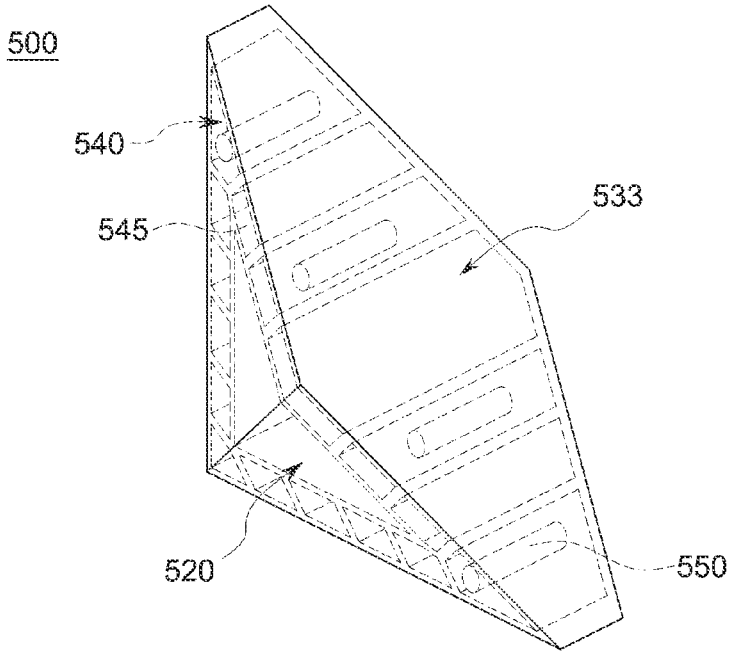

The fifth 3D block 500 has the shape of an isosceles right triangle on a plane. The two sides of equal length of the fifth 3D block 500 are defined as each having a fifth length L5 (See FIG. 12B). The fifth length L5 is $\sqrt{2}$ times longer than the first length L1.

Figure 14A:
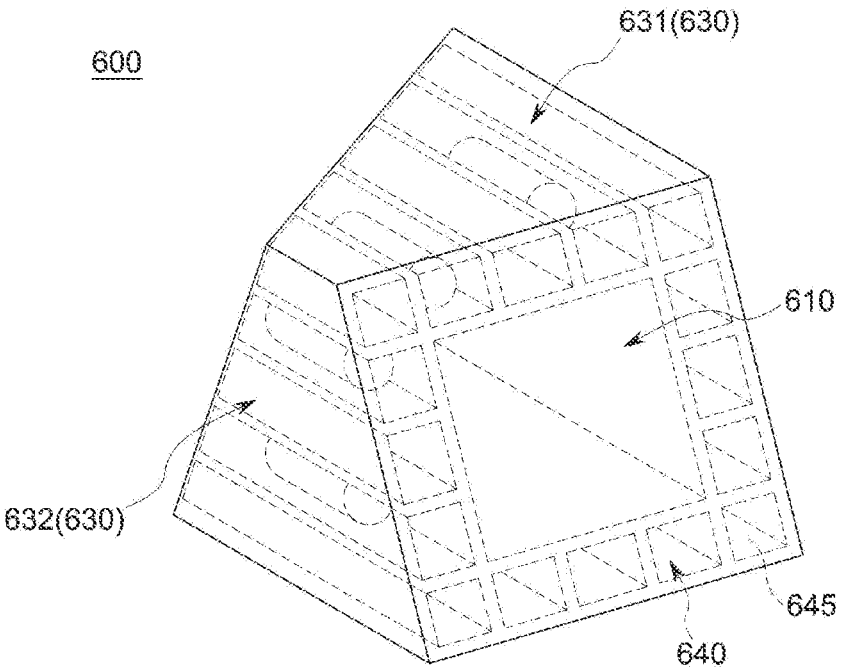
FIGS. 14A, 14B, 15A, and 15B show a sixth 3D block constituting the pickagram three-dimensional puzzle of FIG. 1.
Figure 14B:
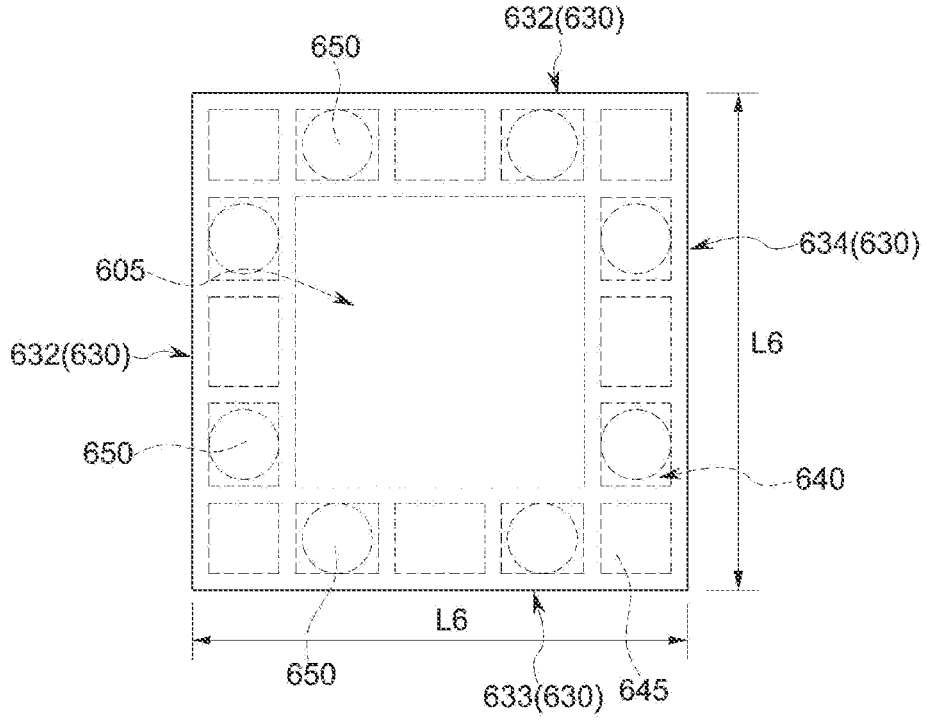
Figure 15A:
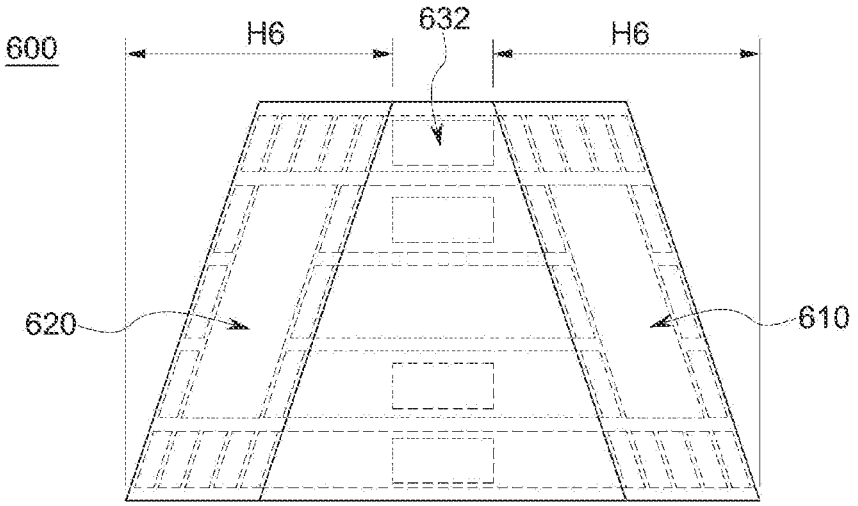
Figure 15B:
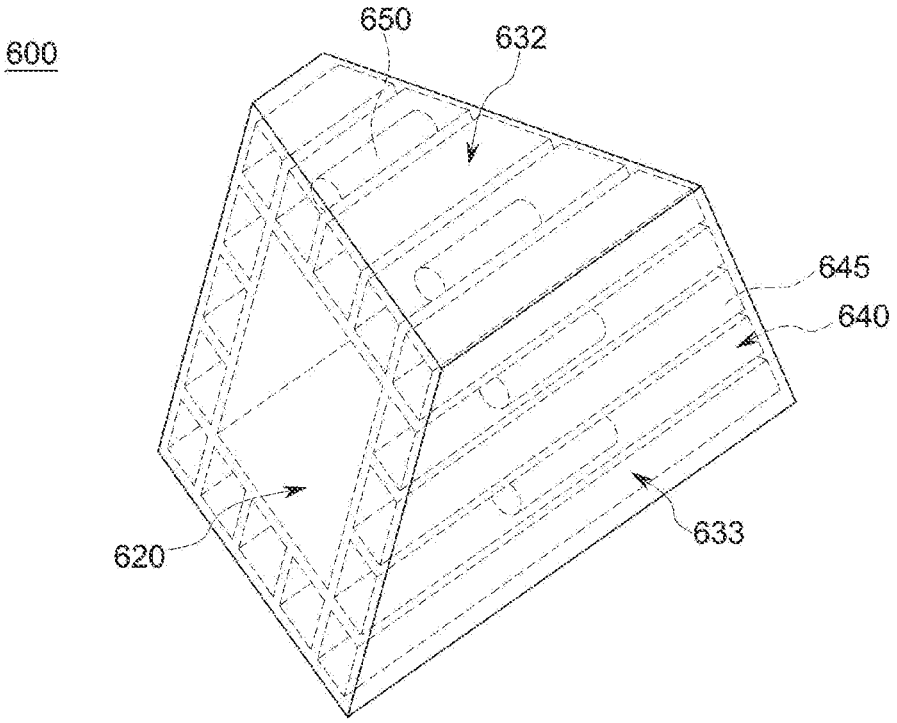

The sixth 3D block 600 has the shape of a square on a plane. Sides of the sixth 3D block 600 are defined as each having a sixth length L6 (See FIG. 14B). The sixth length L6 is equal to the first length L1.

Figure 16A:
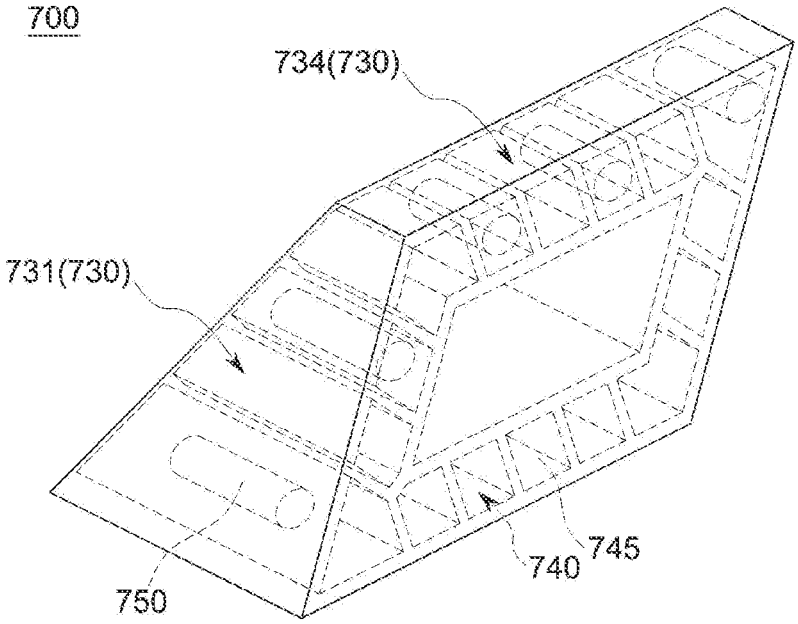
FIGS. 16A, 16B, 17A, and 17B show a seventh 3D block constituting the pickagram three-dimensional puzzle of FIG. 1.
Figure 16B:
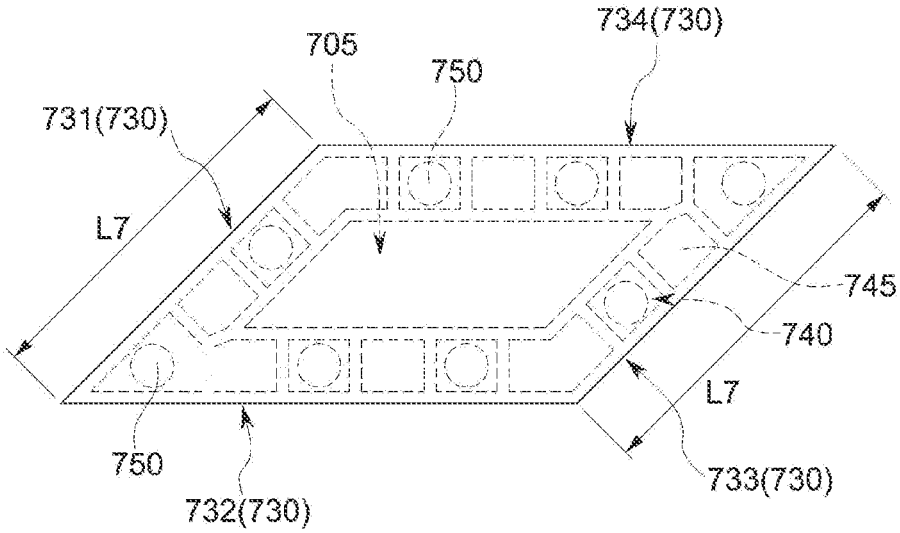
Figure 17A:
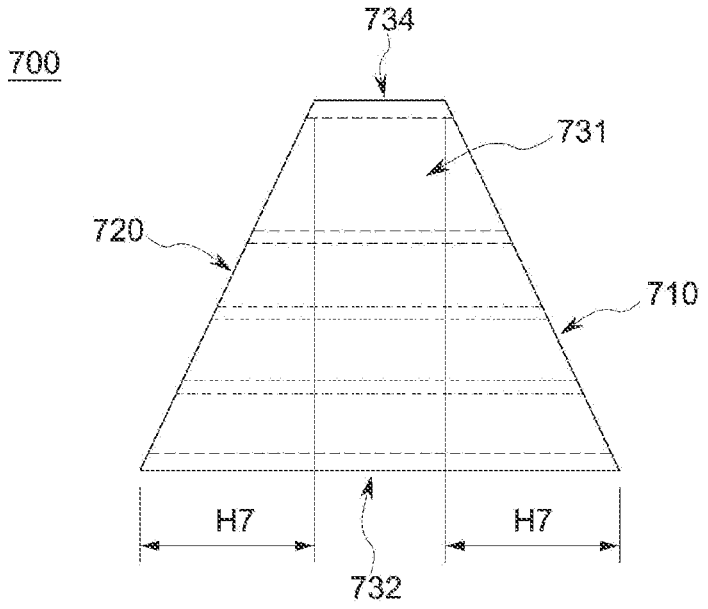
Figure 17B:
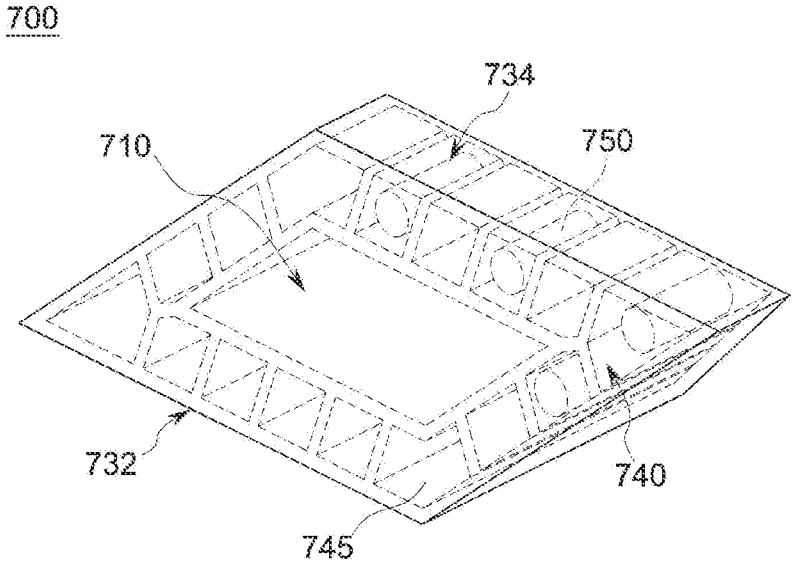

The seventh 3D block 700 has the shape of a parallelogram on a plane. The first opposite sides of the seventh 3D block 700 are defined as each having a seventh length L7 (See FIG. 16B), and the second opposite sides thereof having eighth length (with no reference symbols). The seventh length L7 is $\sqrt{2}$ times longer than the first length L1. The eighth length L8 is equal to the first length L1.

In the description, the directions of the first to seventh lengths L1 to L7 are parallel with an X-Y plane. Further, the directions of heights as will be discussed later are parallel with a Z axis. Now, explanations of the first to seventh 3D blocks 100 to 700 will be given below.

FIGS. 4A, 4B, 5A, and 5B show the first 3D block constituting the pickagram three-dimensional puzzle of FIG. 1.

Referring to FIGS. 4A, 4B, 5A, and 5B, the first 3D block 100 according to one embodiment of the present disclosure includes a first top face 110, a first bottom face 120, a first lateral face 130, first accommodation pipes 140, first partition pipes 145, and a first space portion 105.

The first top face 110 is located on one side of the first lateral face 130. The first top face 110 has the shape of an isosceles right triangle on a plane. The first top face 110 extends inclinedly from one side of the first lateral face 130 toward one side thereof. Accordingly, the first top face 110 has a first height H1. The first top face 110 becomes reduced in width as it extends toward one side thereof.

The first bottom face 120 is spaced apart from the first top face 110. The first bottom face 120 is located to be opposite to the first top face 110. The first bottom face 120 is located on the other side of the first lateral face 130. The first bottom face 120 has the shape of an isosceles right triangle on a plane. The first bottom face 120 extends inclinedly from the other side of the first lateral face 130 toward the other side thereof. Accordingly, the first bottom face 120 has the same first height H1 as the first top face 110. The first bottom face 120 becomes reduced in width as it extends toward one side thereof.

The first lateral face 130 connects the boundary edges of the first top face 110 and the boundary edges of the first bottom face 120 to one another. The first lateral face 130 surrounds the edges of the first space portion 105. In the embodiment of the present disclosure, the first lateral face 130 extends from the boundary edges of the first top face 110 toward the first bottom face 120 and is thus connected to the boundary edges of the first bottom face 120.

The first lateral face 130 includes a first lateral region 131, a second lateral region 132, and a third lateral region 133. The first lateral region 131 has the shape of an isosceles trapezoid. The first lateral region 131 has the first length L1. In the embodiment of the present disclosure, the length of the first lateral region 131 is a distance between one end and the other end of the first lateral region 131. One end of the first lateral region 131 is connected to one end of the second lateral region 132. The other end of the first lateral region 131 is connected to one end of the third lateral region 133. A height of one end of the first lateral region 131 is higher than a height of the other end thereof.

The second lateral region 132 has the shape of an isosceles trapezoid. The second lateral region 132 extends vertically from one end of the first lateral region 131 and is thus connected to the other end of the third lateral region 133. In the embodiment of the present disclosure, a height of one end of the second lateral region 132 is higher than a height of the other end of the second lateral region 132. The second lateral region 132 has the first length L1.

In the embodiment of the present disclosure, the length of the second lateral region 132 is a distance between one end and the other end of the second lateral region 132. One end of the second lateral region 132 is connected to one end of the first lateral region 131. The other end of the second lateral region 132 is connected to the other end of the third lateral region 133.

The third lateral region 133 has the shape of a rectangle. The third lateral region 133 connects the other end of the first lateral region 131 and the other end of the second lateral region 132 to each other. A length of the third lateral region 133 is $\sqrt{2}$ times longer than the first length L1. The length of the third lateral region 133 is a distance between one end and the other end of the third lateral region 133. A height H of the third lateral region 133 is constant. The height H of the third lateral region 133 is equal to the height of the other end of the first lateral region 131 and the height of the other end of the second lateral region 132.

The first height H1 of the first top face 110 and the first height H1 of the first bottom face 120 are distances calculated by multiplying a value obtained by subtracting the height of the other end of the first lateral region 131 from the height of one end of the first lateral region 131 by 0.5.

The first space portion 105 is located inside the first 3D block 100. The first space portion 105 is surrounded with the first top face 110, the first bottom face 120, and the first lateral face 130. In an embodiment of the present disclosure, the first space portion 105 is empty. In another embodiment of the present disclosure, unlike this, the first space portion 105 is filled with a shock absorbing material.

The first accommodation pipes 140 are located inside the first lateral face 130. That is, the first accommodation pipes 140 are located inside the first space portion 105. The first accommodation pipes 140 are located on the underside of the first lateral face 130. The first accommodation pipes 140 are arranged along the first lateral face 130. The first accommodation pipes 140 are spaced apart from one another. The first accommodation pipes 140 are located long in a direction vertical with respect to the direction of the first length L1. In an embodiment of the present disclosure, the first accommodation pipes 140 include a first accommodation pipe, a second accommodation pipe, a third accommodation pipe, a fourth accommodation pipe, and a fifth accommodation pipe.

The first accommodation pipe is located at a region where the first lateral region 131 and the third lateral region 133 are connected to each other. The second accommodation pipe is located at a region where the second lateral region 132 and the third lateral region 133 are connected to each other. The third accommodation pipe is located between the first accommodation pipe and the second accommodation pipe on the third lateral region 133. The first accommodation pipe, the second accommodation pipe, and the third accommodation pipe have the same length as one another.

The fourth accommodation pipe is located on the first lateral region 131. The fourth accommodation pipe is longer than the first accommodation pipe, the second accommodation pipe, and the third accommodation pipe. The fifth accommodation pipe is located on the second lateral region 132. The fifth accommodation pipe is longer than the first accommodation pipe, the second accommodation pipe, and the third accommodation pipe.

A distance between the first accommodation pipe and the third accommodation pipe is equal to the distance between the first accommodation pipe and the fourth accommodation pipe. A distance between the second accommodation pipe and the third accommodation pipe is equal to a distance between the second accommodation pipe and the fourth accommodation pipe.

The first partition pipes 145 are located inside the first lateral face 130. That is, the first partition pipes 145 are located inside the first space portion 105. The first partition pipes 145 are located on the underside of the first lateral face 130. The first partition pipes 145 are arranged along the first lateral face 130.

The first partition pipes 145 are located long in a direction vertical with respect to the direction of the first length L1. The first partition pipes 145 are spaced apart from one another. Each first partition pipe 145 is located between the neighboring first accommodation pipes 140. The first partition pipes 145 have spaces formed therein.

The magnetic members include first magnetic members 150. The first magnetic members 150 are located inside the first accommodation pipes 140. The first magnetic members 150 are located long along the longitudinal directions of the first accommodation pipes 140. The first magnetic members 150 are located long in a direction vertical with respect to the direction of the first length L1.

The first magnetic members 150 located inside the first accommodation pipes 140 move with respect to the longitudinal directions thereof. Accordingly, when the first magnetic members 150 are adjacent to other magnetic members, they easily move to allow different magnetic forces from the magnetic forces of other magnetic members to be attracted to other magnetic members.

The first magnetic members 150 are restricted in the movements in the longitudinal directions by means of first stopper members located inside the first accommodation pipes 140. The first stopper members are located on one end and the other end of each first magnetic member 150.

FIGS. 6A, 6B, 7A, and 7B show the second 3D block constituting the pickagram three-dimensional puzzle of FIG. 1.

Referring to FIGS. 6A, 6B, 7A, and 7B, the second 3D block 200 according to one embodiment of the present disclosure includes a second top face 210, a second bottom face 220, a second lateral face 230, second accommodation pipes 240, second partition pipes 245, and a second space portion 205.

The second top face 210 is located on one side of the second lateral face 230. The second top face 210 has the shape of an isosceles right triangle on a plane. The second top face 210 extends inclinedly from one side of the second lateral face 230 toward one side thereof. Accordingly, the second top face 210 has a second height H2. The second top face 210 becomes reduced in width as it extends toward one side thereof.

The second bottom face 220 is spaced apart from the second top face 210. The second bottom face 220 is located to be opposite to the second top face 210. The second bottom face 120 is located on the other side of the second lateral face 230. The second bottom face 220 has the shape of an isosceles right triangle on a plane. The second bottom face 220 extends inclinedly from the other side of the second lateral face 230 toward the other side thereof. Accordingly, the second bottom face 220 has the same second height H2 as the second top face 210. The second bottom face 220 becomes reduced in width as it extends toward one side thereof.

The second lateral face 230 connects the boundary edges of the second top face 210 and the boundary edges of the second bottom face 220 to one another. The second lateral face 230 surrounds the edges of the second space portion 205. In the embodiment of the present disclosure, the second lateral face 230 extends from the boundary edges of the second top face 210 toward the second bottom face 220 and is thus connected to the boundary edges of the second bottom face 220.

The second lateral face 230 includes a first lateral region 231, a second lateral region 232, and a third lateral region 233. The first lateral region 231 has the shape of an isosceles trapezoid. The first lateral region 231 has the second length L2. In the embodiment of the present disclosure, the length of the first lateral region 231 is a distance between one end and the other end of the first lateral region 231. One end of the first lateral region 231 is connected to one end of the second lateral region 232. The other end of the first lateral region 231 is connected to one end of the third lateral region 233. A height of one end of the first lateral region 231 is higher than a height of the other end thereof.

The second lateral region 232 has the shape of an isosceles trapezoid. The second lateral region 232 extends vertically from one end of the first lateral region 231 and is thus connected to the other end of the third lateral region 233. In the embodiment of the present disclosure, a height of one end of the second lateral region 232 is higher than a height of the other end thereof. The second lateral region 232 has the second length L2. The second length L2 is two times longer than the first length L1.

In the embodiment of the present disclosure, the length of the second lateral region 232 is a distance between one end and the other end of the second lateral region 232. One end of the second lateral region 232 is connected to one end of the first lateral region 231. The other end of the second lateral region 232 is connected to the other end of the third lateral region 233.

The third lateral region 233 has the shape of a rectangle. The third lateral region 233 connects the other end of the first lateral region 231 and the other end of the second lateral region 232 to each other. A length of the third lateral region 233 is $\sqrt{2}$ times longer than the second length L2. A height H of the third lateral region 133 is constant. The height H of the third lateral region 233 is equal to the height of the other end of the first lateral region 231 and the height of the other end of the second lateral region 232. Accordingly, a size of the third lateral region 233 is two times greater than a size of the third lateral region 133 of the first lateral face 130.

The second height H2 of the second top face 210 and the second height H2 of the second bottom face 220 are distances calculated by multiplying a value obtained by subtracting the height of the other end of the first lateral region 231 from the height of one end of the second lateral region 231 by 0.5.

The second space portion 205 is located inside the second 3D block 200. The second space portion 205 is surrounded with the second top face 210, the second bottom face 220, and the second lateral face 230. In an embodiment of the present disclosure, the second space portion 205 is empty. In another embodiment of the present disclosure, unlike this, the second space portion 205 is filled with a shock absorbing material.

The second accommodation pipes 240 are located inside the second lateral face 230. That is, the second accommodation pipes 240 are located inside the second space portion 205. The second accommodation pipes 240 are located on the underside of the second lateral face 230. The second accommodation pipes 240 are arranged along the second lateral face 230. The second accommodation pipes 240 are spaced apart from one another. The second accommodation pipes 240 are located long in a direction vertical with respect to the direction of the second length L2.

The first accommodation pipe of the second accommodation pipes 240 is located at a region where the first lateral region 231 and the third lateral region 233 are connected to each other. The second accommodation pipe of the second accommodation pipes 240 is located at a region where the second lateral region 232 and the third lateral region 233 are connected to each other. At least one of the second accommodation pipes 240 is located between the first accommodation pipe and the second accommodation pipe on the third lateral region 233. The second accommodation pipes 240 located on the third lateral region 233 have the same length as one another. The second accommodation pipes 240 are located even on the first lateral region 231 and the second lateral region 232.

The second partition pipes 245 are located inside the second lateral face 230. That is, the second partition pipes 245 are located inside the second space portion 205. The second partition pipes 245 are located on the underside of the second lateral face 230. The second partition pipes 245 are arranged along the second lateral face 230.

The second partition pipes 245 are located long in a direction vertical with respect to the direction of the second length L2. The second partition pipes 245 are spaced apart from one another. Each second partition pipe 245 is located between the neighboring second accommodation pipes 240. The second partition pipes 245 have spaces formed therein.

The magnetic members include second magnetic members 250. The second magnetic members 250 are located inside the second accommodation pipes 240. The second magnetic members 250 are located long along the longitudinal directions of the second accommodation pipes 240. The second magnetic members 250 are located long in a direction vertical with respect to the direction of the second length L2.

The second magnetic members 250 located inside the second accommodation pipes 240 move with respect to the longitudinal directions thereof. Accordingly, when the second magnetic members 250 are adjacent to other magnetic members, they easily move to allow different magnetic forces from the magnetic forces of other magnetic members to be attracted to other magnetic members.

The second magnetic members 250 are restricted in the movements in the longitudinal directions by means of second stopper members located inside the second accommodation pipes 240. The second stopper members are located on one end and the other end of each second magnetic member 250.

FIGS. 8A, 8B, 9A, and 9B show the third 3D block constituting the pickagram three-dimensional puzzle of FIG. 1.

Referring to FIGS. 8A, 8B, 9A, and 9B, the third 3D block 300 according to one embodiment of the present disclosure includes a third top face 310, a third bottom face 320, a third lateral face 330, third accommodation pipes 340, third partition pipes 345, and a third space portion 305.

The third top face 310 is located on one side of the third lateral face 330. The third top face 310 has the shape of an isosceles right triangle on a plane. The third top face 310 extends inclinedly from one side of the third lateral face 330 toward one side thereof. Accordingly, the third top face 310 has a third height H3. The third top face 310 becomes reduced in width as it extends toward one side thereof.

The third bottom face 320 is spaced apart from the third top face 310. The third bottom face 320 is located to be opposite to the third top face 310. The third bottom face 320 is located on the other side of the third lateral face 330. The third bottom face 320 has the shape of an isosceles right triangle on a plane. The third bottom face 320 extends inclinedly from the other side of the third lateral face 330 toward the other side thereof. Accordingly, the third bottom face 320 has the same third height H3 as the third top face 310. The third bottom face 320 becomes reduced in width as it extends toward one side thereof.

The third lateral face 330 connects the boundary edges of the third top face 310 and the boundary edges of the third bottom face 320 to one another. The third lateral face 330 surrounds the edges of the third space portion 305. In the embodiment of the present disclosure, the third lateral face 330 extends from the boundary edges of the third top face 310 toward the third bottom face 320 and is thus connected to the boundary edges of the third bottom face 320.

The third lateral face 230 includes a first lateral region 331, a second lateral region 332, and a third lateral region 333. The first lateral region 331 has the shape of an isosceles trapezoid. The first lateral region 331 has the third length L3. In the embodiment of the present disclosure, the length of the first lateral region 331 is a distance between one end and the other end of the first lateral region 331. One end of the first lateral region 331 is connected to one end of the second lateral region 332. The other end of the first lateral region 331 is connected to one end of the third lateral region 333. A height of one end of the first lateral region 331 is higher than a height of the other end thereof.

The second lateral region 332 has the shape of an isosceles trapezoid. The second lateral region 332 extends vertically from one end of the first lateral region 331 and is thus connected to the other end of the third lateral region 333. In the embodiment of the present disclosure, a height of one end of the second lateral region 332 is higher than a height of the other end thereof. The second lateral region 332 has the third length L3. The third length L3 is two times longer than the first length L1. The third length L3 is the same as the second length L2. Accordingly, the third 3D block 300 has a bigger size than the first 3D block 100. Further, the third 3D block 300 has the same size as the second 3D block 200.

In the embodiment of the present disclosure, the length of the second lateral region 332 is a distance between one end and the other end of the second lateral region 332. One end of the second lateral region 332 is connected to one end of the first lateral region 331. The other end of the second lateral region 332 is connected to the other end of the third lateral region 333.

The third lateral region 333 has the shape of a rectangular. The third lateral region 333 connects the other end of the first lateral region 331 and the other end of the second lateral region 332 to each other. A length of the third lateral region 333 is $\sqrt{2}$ times longer than the third length L3. A length of the third lateral region 333 is two times longer than a length of the third lateral region 133 of the first lateral face 130.

A height H of the third lateral region 333 is equal to the height of the third lateral region 131 of the first lateral face 130 and the height of the third lateral region 233 of the second lateral face 230. Accordingly, a size of the third lateral region 333 is two times bigger than a size of the third lateral region 133 of the first lateral face 130. Further, the size of the third lateral region 333 is equal to a size of the third lateral region 233 of the second lateral face 230.

The third height H3 of the third top face 310 and the third height H3 of the third bottom face 320 are distances calculated by multiplying a value obtained by subtracting the height of the other end of the first lateral region 331 from the height of one end of the first lateral region 331 by 0.5.

The third space portion 305 is located inside the third 3D block 300. The third space portion 305 is surrounded with the third top face 310, the third bottom face 320, and the third lateral face 330. In an embodiment of the present disclosure, the third space portion 305 is empty. In another embodiment of the present disclosure, unlike this, the third space portion 305 is filled with a shock absorbing material.

The third accommodation pipes 340 are located inside the third lateral face 330. That is, the third accommodation pipes 340 are located inside the third space portion 305. The third accommodation pipes 340 are located on the underside of the third lateral face 330. The third accommodation pipes 340 are arranged along the third lateral face 330. The third accommodation pipes 340 are spaced apart from one another. The third accommodation pipes 340 are located long in a direction vertical with respect to the direction of the third length L3.

The first accommodation pipe of the third accommodation pipes 340 is located at a region where the first lateral region 331 and the third lateral region 333 are connected to each other. The second accommodation pipe of the third accommodation pipes 340 is located at a region where the second lateral region 332 and the third lateral region 333 are connected to each other. At least one of the third accommodation pipes 340 is located between the first accommodation pipe and the second accommodation pipe on the third lateral region 333. The third accommodation pipes 340 located on the third lateral region 333 have the same length as one another. The third accommodation pipes 340 are located even on the first lateral region 331 and the second lateral region 332.

The third partition pipes 345 are located inside the third lateral face 330. That is, the third partition pipes 345 are located inside the third space portion 305. The third partition pipes 345 are located on the underside of the third lateral face 330. The third partition pipes 345 are arranged along the third lateral face 330.

The third partition pipes 345 are located long in a direction vertical with respect to the direction of the third length L3. The third partition pipes 345 are spaced apart from one another. Each third partition pipe 345 is located between the neighboring third accommodation pipes 340. The third partition pipes 345 have spaces formed therein.

The magnetic members include third magnetic members 350. The third magnetic members 350 are located inside the third accommodation pipes 340. The third magnetic members 350 are located long along the longitudinal directions of the third accommodation pipes 340. The third magnetic members 350 are located long in a direction vertical with respect to the direction of the third length L3.

The third magnetic members 350 located inside the third accommodation pipes 340 move with respect to the longitudinal directions thereof. Accordingly, when the third magnetic members 350 are adjacent to other magnetic members, they easily move to allow different magnetic forces from the magnetic forces of other magnetic members to be attracted to other magnetic members.

The third magnetic members 350 are restricted in the movements in the longitudinal directions by means of third stopper members located inside the third accommodation pipes 340. The third stopper members are located on one end and the other end of each third magnetic member 350.

FIGS. 10A, 10B, 11A, and 11B show the fourth 3D block constituting the pickagram three-dimensional puzzle of FIG. 1.

Referring to FIGS. 10A, 10B, 11A, and 11B, the fourth 3D block 400 according to one embodiment of the present disclosure includes a fourth top face 410, a fourth bottom face 420, a fourth lateral face 430, fourth accommodation pipes 440, fourth partition pipes 445, and a fourth space portion 405.

The fourth top face 410 is located on one side of the fourth lateral face 430. The fourth top face 410 has the shape of an isosceles right triangle on a plane. The fourth top face 410 extends inclinedly from one side of the fourth lateral face 430 toward one side thereof. Accordingly, the fourth top face 410 has a fourth height H4. The fourth top face 410 becomes reduced in width as it extends toward one side thereof.

The fourth bottom face 420 is spaced apart from the fourth top face 410. The fourth bottom face 420 is located to be opposite to the fourth top face 410. The fourth bottom face 420 is located on the other side of the fourth lateral face 430. The fourth bottom face 420 has the shape of an isosceles right triangle on a plane. The fourth bottom face 420 extends inclinedly from the other side of the fourth lateral face 430 toward the other side thereof. Accordingly, the fourth bottom face 420 has the same fourth height H4 as the fourth top face 410. The fourth bottom face 420 becomes reduced in width as it extends toward one side thereof.

The fourth lateral face 430 connects the boundary edges of the fourth top face 410 and the boundary edges of the fourth bottom face 420 to one another. The fourth lateral face 430 surrounds the edges of the fourth space portion 405. In the embodiment of the present disclosure, the fourth lateral face 430 extends from the boundary edges of the fourth top face 410 toward the fourth bottom face 420 and is thus connected to the boundary edges of the fourth bottom face 420.

The fourth lateral face 430 includes a first lateral region 431, a second lateral region 432, and a third lateral region 433. The first lateral region 431 has the shape of an isosceles trapezoid. The first lateral region 431 has the fourth length L4. In the embodiment of the present disclosure, the length of the first lateral region 431 is a distance between one end and the other end of the first lateral region 431. The fourth length L4 is the same as the first length L1.

One end of the first lateral region 431 is connected to one end of the second lateral region 432. The other end of the first lateral region 431 is connected to one end of the third lateral region 433. A height of one end of the first lateral region 431 is higher than a height of the other end thereof. The height of one end of the first lateral region 431 is the same as the height of one end of the first lateral region 331 of the third lateral face 330. A height of the other end of the first lateral region 431 is higher than the height of the other end of the first lateral region 331 of the third lateral face 330.

The second lateral region 432 has the shape of an isosceles trapezoid. The second lateral region 432 extends vertically from one end of the first lateral region 431 and is thus connected to the other end of the third lateral region 433.

One end of the second lateral region 432 is connected to one end of the first lateral region 431. The other end of the second lateral region 432 is connected to the other end of the third lateral region 433. A height of one end of the second lateral region 432 is higher than a height of the other end of the second lateral region 432. The height of one end of the second lateral region 432 is the same as the height of one end of the second lateral region 332 of the third lateral face 330. A height of the other end of the first lateral region 431 is higher than the height of the other end of the second lateral region 332 of the third lateral face 330.

The second lateral region 432 has the fourth length L4. In the embodiment of the present disclosure, the length of the second lateral region 432 is a distance between one end and the other end of the second lateral region 432. The fourth length L4 is the same as the first length L1. The fourth length L4 is 0.5 times longer than the second length L2 or the third length L3. Accordingly, the fourth 3D block 400 has a smaller size than the second 3D block 200 and the third 3D block 300.

The third lateral region 433 has the shape of a rectangle. The third lateral region 433 connects the other end of the first lateral region 431 and the other end of the second lateral region 432 to each other. A length of the third lateral region 433 is $\sqrt{2}$ times longer than the fourth length L4. The length of the third lateral region 433 is a distance between one end and the other end of the third lateral region 433. A height H of the third lateral region 433 is constant. The height H of the third lateral region 433 is higher than the height H of the third lateral region 133 of the first lateral face 130 and the height H of the third lateral region 233 of the second lateral face 230.

The fourth height H4 of the fourth top face 410 and the fourth height H4 of the fourth bottom face 420 are distances calculated by multiplying a value obtained by subtracting the height of the other end of the first lateral region 431 from the height of one end of the first lateral region 431 by 0.5.

The fourth space portion 405 is located inside the fourth 3D block 400. The fourth space portion 405 is surrounded with the fourth top face 410, the fourth bottom face 420, and the fourth lateral face 430. In an embodiment of the present disclosure, the fourth space portion 405 is empty. In another embodiment of the present disclosure, unlike this, the fourth space portion 405 is filled with a shock absorbing material.

The fourth accommodation pipes 440 are located inside the fourth lateral face 430. That is, the fourth accommodation pipes 440 are located inside the fourth space portion 405. The fourth accommodation pipes 440 are located on the underside of the fourth lateral face 430. The fourth accommodation pipes 440 are arranged along the fourth lateral face 430. The fourth accommodation pipes 440 are spaced apart from one another. The fourth accommodation pipes 440 are located long in a direction vertical with respect to the direction of the fourth length L4.

The first accommodation pipe of the fourth accommodation pipes 440 is located at a region where the first lateral region 431 and the third lateral region 433 are connected to each other. The second accommodation pipe of the fourth accommodation pipes 440 is located at a region where the second lateral region 432 and the third lateral region 433 are connected to each other. At least one of the fourth accommodation pipes 440 is located between the first accommodation pipe and the second accommodation pipe on the third lateral region 433. The fourth accommodation pipes 440 located on the third lateral region 433 have the same length as one another. The fourth accommodation pipes 440 are located on the first lateral region 431 and the second lateral region 432.

The fourth partition pipes 445 are located inside the fourth lateral face 430. That is, the fourth partition pipes 445 are located inside the fourth space portion 405. The fourth partition pipes 445 are located on the underside of the fourth lateral face 430. The fourth partition pipes 445 are arranged along the fourth lateral face 430.

The fourth partition pipes 445 are located long in a direction vertical with respect to the direction of the fourth length L4. The fourth partition pipes 445 are spaced apart from one another. Each fourth partition pipe 445 is located between the neighboring fourth accommodation pipes 440. The fourth partition pipes 445 have spaces formed therein.

The magnetic members include fourth magnetic members 450. The fourth magnetic members 450 are located inside the fourth accommodation pipes 440. The fourth magnetic members 450 are located long along the longitudinal directions of the fourth accommodation pipes 440. The fourth magnetic members 450 are located long in a direction vertical with respect to the direction of the fourth length L4.

The fourth magnetic members 450 located inside the fourth accommodation pipes 440 move with respect to the longitudinal directions thereof. Accordingly, when the fourth magnetic members 450 are adjacent to other magnetic members, they easily move to allow different magnetic forces from the magnetic forces of other magnetic members to be attracted to other magnetic members.

The fourth magnetic members 450 are restricted in the movements in the longitudinal directions by means of fourth stopper members located inside the fourth accommodation pipes 440. The fourth stopper members are located on one end and the other end of each fourth magnetic member 450.

FIGS. 12A, 12B, 13A, and 13B show the fifth 3D block constituting the pickagram three-dimensional puzzle of FIG. 1.

Referring to FIGS. 12A, 12B, 13A, and 13B, the fifth 3D block 500 according to one embodiment of the present disclosure includes a fifth top face 510, a fifth bottom face 520, a fifth lateral face 530, fifth accommodation pipes 540, fifth partition pipes 545, and a fifth space portion 505.

The fifth top face 510 is located on one side of the fifth lateral face 530. The fifth top face 510 has the shape of an isosceles right triangle on a plane. The fifth top face 510 includes a first top region and a second top region.

The first top region and the second top region each have the shapes of isosceles right triangle on a plane. The first top region and the second top region are connected to each other. The first top region and the second top region are symmetrical to each other with respect to the contacted sides thereof.

The first plane region extends inclinedly from one side of a first lateral region 531 as will be discussed later toward one side thereof. Accordingly, the first top region has a fifth height H5. The first top region becomes reduced in width as it extends toward one side thereof. The fifth height H5 is the same as the first height H1.

The second top region extends inclinedly from one side of a second lateral region 532 as will be discussed later toward one side thereof. Accordingly, the second top region has the fifth height H5. The second plane region becomes reduced in width as it extends toward one side thereof. The fifth height H5 is the same as the first height H1.

The fifth bottom face 520 is spaced apart from the fifth top face 510. The fifth bottom face 520 is located to be opposite to the fifth top face 510. The fifth bottom face 520 is located on the other side of the fifth lateral face 530. The fifth bottom face 520 has the shape of an isosceles right triangle on a plane. The fifth bottom face 520 includes a first bottom region and a second bottom region.

The first bottom region and the second bottom region each have the shape of an isosceles right triangle on a plane. The first bottom region and the second bottom region are connected to each other. The first bottom region and the second bottom region are symmetrical to each other with respect to the contacted sides thereof.

The first bottom region extends inclinedly from the other side of the first lateral region 531 as will be discussed later toward the other side thereof. Accordingly, the first bottom region has the fifth height H5. The first bottom region becomes reduced in width as it extends toward the other side thereof. The fifth height H5 is the same as the first height H1.

The second bottom region extends inclinedly from the other side of the second lateral region 532 as will be discussed later toward the other side thereof. Accordingly, the second bottom region has the fifth height H5. The second bottom region becomes reduced in width as it extends toward the other side thereof. The fifth height H5 is the same as the first height H1.

The fifth lateral face 530 connects the boundary edges of the fifth top face 510 and the boundary edges of the fifth bottom face 520 to one another. In the embodiment of the present disclosure, the fifth lateral face 530 extends from the boundary edges of the fifth top face 510 toward the fifth bottom face 520 and is thus connected to the boundary edges of the fifth bottom face 520. The fifth lateral face 530 surrounds the edges of the fifth space portion 505.

The fifth lateral face 530 includes the first lateral region 531, the second lateral region 532, and a third lateral region 533. The first lateral region 531 has the shape of a rectangle. The first lateral region 531 has the fifth length L5. The fifth length L5 is the same as a distance between one end and the other end of the first lateral region 531.

One end of the first lateral region 531 is connected to one end of the second lateral region 532. The other end of the first lateral region 531 is connected to one end of the third lateral region 533. A height H of one end of the first lateral region 531 is almost the same as the height of one end of the first lateral region 131 of the first lateral face 130.

The second lateral region 532 has the shape of a rectangle. The second lateral region 532 extends vertically from one end of the first lateral region 531 and is thus connected to the other end of the third lateral region 533. The second lateral region 532 has the fifth length L5. The length of the second lateral region 532 is a distance between one end and the other end of the second lateral region 532.

The fifth length L5 is almost $\sqrt{2}$ times longer than the first length L1. Further, the fifth length L5 is shorter than the second length L2 or the third length L3. Accordingly, the fifth 3D block 500 has a smaller size than the second 3D block 200 and the third 3D block 300 and a bigger size than the first 3D block 100.

The third lateral region 533 includes a first region and a second region. One end of the first region is connected to the other end of the first lateral region 531. One end of the second region is connected to the other end of the second lateral region 532.

The first region and the second region each have the shape of an isosceles trapezoid. One end and the other end of the first region are parallel with each other, and one end and the other end of the second region are parallel with each other. A height of the other end of the first region is higher than a height of one end thereof. A height of the other end of the second region is higher than a height of one end thereof. The other end of the first region is connected to the other end of the second region. In the embodiment of the present disclosure, the first region and the second region are symmetrical to each other with respect to the other end of the first region or the other end of the second region.

A length of the third lateral region 533 is $\sqrt{2}$ times longer than the fifth length L5. Further, the length of the third lateral region 533 is about two times longer than the first length L1. The length of the third lateral region 533 is a distance between one end and the other end of the third lateral region 533. That is, the length of the third lateral region 533 is a distance between one end of the first region and one end of the second region.

The fifth height H5 is a distance calculated by multiplying a value obtained by subtracting the height of the other end of the first region from the height of one end of the first region by 0.5.

The fifth space portion 505 is located inside the fifth 3D block 500. The fifth space portion 505 is surrounded with the fifth top face 510, the fifth bottom face 520, and the fifth lateral face 530. In an embodiment of the present disclosure, the fifth space portion 505 is empty. In another embodiment of the present disclosure, unlike this, the fifth space portion 505 is filled with a shock absorbing material.

The fifth accommodation pipes 540 are located inside the fifth lateral face 530. That is, the fifth accommodation pipes 540 are located inside the fifth space portion 505. The fifth accommodation pipes 540 are located on the underside of the fifth lateral face 530. The fifth accommodation pipes 540 are arranged along the fifth lateral face 530. The fifth accommodation pipes 540 are spaced apart from one another. The fifth accommodation pipes 540 are located long in a direction vertical with respect to the direction of the fifth length L5.

One of the fifth accommodation pipes 540 is located at a region where the first lateral region 531 and the third lateral region 533 are connected to each other. One of the fifth accommodation pipes 540 is located at a region where the second lateral region 532 and the third lateral region 533 are connected to each other. Some of the fifth accommodation pipes 540 are located on the first lateral region 531, the second lateral region 532, and the third lateral region 533. The fifth accommodation pipes 540 located on the first lateral region 531 and the second lateral region 532 have the same length as one another.

The fifth partition pipes 545 are located inside the fifth lateral face 530. That is, the fifth partition pipes 545 are located inside the fifth space portion 505. The fifth partition pipes 545 are located on the underside of the fifth lateral face 530. The fifth partition pipes 545 are arranged along the fifth lateral face 530.

The fifth partition pipes 545 are located long in a direction vertical with respect to the direction of the fifth length L5. The fifth partition pipes 545 are spaced apart from one another. Each fifth partition pipe 545 is located between the neighboring fifth accommodation pipes 540. The fifth partition pipes 545 have spaces formed therein.

The magnetic members include fifth magnetic members 550. The fifth magnetic members 550 are located inside the fifth accommodation pipes 540. The fifth magnetic members 550 are located long along the longitudinal directions of the fifth accommodation pipes 540. The fifth magnetic members 550 are located long in a direction vertical with respect to the direction of the fifth length L5.

The fifth magnetic members 550 located inside the fifth accommodation pipes 540 move with respect to the longitudinal directions thereof. Accordingly, when the fifth magnetic members 550 are adjacent to other magnetic members, they easily move to allow different magnetic forces from the magnetic forces of other magnetic members to be attracted to other magnetic members.

The fifth magnetic members 550 are restricted in the movements in the longitudinal directions by means of fifth stopper members located inside the fifth accommodation pipes 540. The fifth stopper members are located on one end and the other end of each fifth magnetic member 550.

FIGS. 14A, 14B, 15A, and 15B show the sixth 3D block constituting the pickagram three-dimensional puzzle of FIG. 1.

Referring to FIGS. 14A, 14B, 15A, and 15B, the sixth 3D block 600 according to one embodiment of the present disclosure includes a sixth top face 610, a sixth bottom face 620, a sixth lateral face 630, sixth accommodation pipes 640, sixth partition pipes 645, and a sixth space portion 605.

The sixth top face 610 is located on one side of the sixth lateral face 630. The sixth top face 610 has the shape of a square on a plane. The sixth bottom face 620 is spaced apart from the sixth top face 610. The sixth bottom face 620 is located to be opposite to the sixth top face 610. The sixth bottom face 620 is located on the other side of the sixth lateral face 630. The sixth bottom face 620 has the shape of a rectangle on a plane. The sixth top face 610 has a sixth height H6. The sixth height H6 is the same as the first height H1.

The sixth lateral face 630 connects the boundary edges of the sixth top face 610 and the boundary edges of the sixth bottom face 620 to one another. In the embodiment of the present disclosure, the sixth lateral face 630 extends from the boundary edges of the sixth top face 610 toward the sixth bottom face 620 and is thus connected to the boundary edges of the sixth bottom face 620. The sixth lateral face 630 surrounds the edges of the sixth space portion 605. The sixth bottom face 620 has the sixth height H6.

The sixth lateral face 630 includes a first lateral region 631, a second lateral region 632, a third lateral region 633, and a fourth lateral region 634. The first lateral region 631 has the shape of an isosceles trapezoid. The first lateral region 631 has the sixth length L6. In the embodiment of the present disclosure, the sixth length L6 is the same as a distance between one end and the other end of the first lateral region 631. The sixth length L6 is the same as the first length L1.

One end of the first lateral region 631 is connected to one end of the second lateral region 632. The other end of the first lateral region 631 is connected to one end of the fourth lateral region 634. A height of the first lateral region 631 becomes higher toward the other end of the first lateral region 631 from one end thereof.

The second lateral region 632 has the shape of an isosceles trapezoid. A length of the second lateral region 632 is the same as the sixth length L6. In the embodiment of the present disclosure, the length of the second lateral region 632 is a distance between one end and the other end of the second lateral region 632. One end of the second lateral region 632 is connected to one end of the first lateral region 631. The other end of the second lateral region 632 is connected to one end of the third lateral region 633. A height of the second lateral region 632 becomes higher toward the other end of the second lateral region 632 from one end thereof.

The third lateral region 633 has the shape of an isosceles trapezoid. A length of the third lateral region 633 is the same as the sixth length L6. In the embodiment of the present disclosure, the length of the third lateral region 633 is a distance between one end and the other end of the third lateral region 633. One end of the third lateral region 633 is connected to the other end of the second lateral region 632. The other end of the third lateral region 633 is connected to the other end of the fourth lateral region 634. A height of the third lateral region 633 becomes higher toward the other end of the third lateral region 633 from one end thereof.

The fourth lateral region 634 has the shape of an isosceles trapezoid. A length of the fourth lateral region 634 is the same as the sixth length L6. In the embodiment of the present disclosure, the length of the fourth lateral region 634 is a distance between one end and the other end of the fourth lateral region 634. One end of the fourth lateral region 634 is connected to the other end of the first lateral region 631. The other end of the fourth lateral region 634 is connected to the other end of the third lateral region 633. A height of the fourth lateral region 634 becomes higher toward the other end of the fourth lateral region 634 from one end thereof.

The sixth height H6 of the sixth top face 610 and the sixth height H6 of the sixth bottom face 620 are distances calculated by multiplying a value obtained by subtracting the height of one end of the first lateral region 631 from the height of the other end of the third lateral region 633 by 0.5.

The sixth space portion 605 is located inside the sixth 3D block 600. The sixth space portion 605 is surrounded with the sixth top face 610, the sixth bottom face 620, and the sixth lateral face 630. In an embodiment of the present disclosure, the sixth space portion 605 is empty. In another embodiment of the present disclosure, unlike this, the sixth space portion 605 is filled with a shock absorbing material.

The sixth accommodation pipes 640 are located inside the sixth lateral face 630. That is, the sixth accommodation pipes 640 are located inside the sixth space portion 605. The sixth accommodation pipes 640 are located on the underside of the sixth lateral face 630. The sixth accommodation pipes 640 are arranged along the sixth lateral face 630. The sixth accommodation pipes 640 are located on the undersides of the first lateral region 631, the second lateral region 632, the third lateral region 633, and the fourth lateral region 634. The sixth accommodation pipes 640 are spaced apart from one another. The sixth accommodation pipes 640 are located long in a direction vertical with respect to the direction of the sixth length L6 or in height directions thereof.

The sixth partition pipes 645 are located inside the sixth lateral face 630. That is, the sixth partition pipes 645 are located inside the sixth space portion 605. The sixth partition pipes 645 are located on the underside of the sixth lateral face 630. The sixth partition pipes 645 are arranged along the sixth lateral face 630. In the embodiment of the present disclosure, one of the sixth partition pipes 645 is located on a region where the first lateral region 631 and the second lateral region 632 are connected to each other. Further, one of the sixth partition pipes 645 is located at a region where the second lateral region 632 and the third lateral region 633 are connected to each other. One of the sixth partition pipes 645 is located at a region where the third lateral region 633 and the fourth lateral region 634 are connected to each other. One of the sixth partition pipes 645 is located at a region where the first lateral region 631 and the fourth lateral region 634 are connected to each other.

The sixth partition pipes 645 are located long in a direction vertical with respect to the direction of the sixth length L6 or in height directions thereof. The sixth partition pipes 645 are spaced apart from one another. Each sixth partition pipe 645 is located between the neighboring sixth accommodation pipes 640. The sixth partition pipes 645 have spaces formed therein.

The magnetic members include sixth magnetic members 650. The sixth magnetic members 650 are located inside the sixth accommodation pipes 640. The sixth magnetic members 650 are located long along the longitudinal directions of the sixth accommodation pipes 640. The sixth magnetic members 650 are located long in a direction vertical with respect to the direction of the sixth length L6 or in height directions thereof.

The sixth magnetic members 650 located inside the sixth accommodation pipes 640 move with respect to the longitudinal directions thereof. Accordingly, when the sixth magnetic members 650 are adjacent to other magnetic members, they easily move to allow different magnetic forces from the magnetic forces of other magnetic members to be attracted to other magnetic members.

The sixth magnetic members 650 are restricted in the movements in the longitudinal directions by means of sixth stopper members located inside the sixth accommodation pipes 640. The sixth stopper members are located on one end and the other end of each sixth magnetic member 650.

FIGS. 16A, 16B, 17A, and 17B show the seventh 3D block constituting the pickagram three-dimensional puzzle of FIG. 1.

Referring to FIGS. 16A, 16B, 17A, and 17B, the seventh 3D block 700 according to one embodiment of the present disclosure includes a seventh top face 710, a seventh bottom face 720, a seventh lateral face 730, seventh accommodation pipes 740, seventh partition pipes 745, and a seventh space portion 705.

The seventh top face 710 is located on one side of the seventh lateral face 730. The seventh top face 710 has the shape of a parallelogram on a plane.

The seventh bottom face 720 is spaced apart from the seventh top face 710. The seventh bottom face 720 is located to be opposite to the seventh top face 710. The seventh bottom face 720 is located on the other side of the seventh lateral face 730. The seventh bottom face 720 has the shape of a parallelogram on a plane. The seventh top face 710 has a seventh height H7.

The seventh lateral face 730 connects the boundary edges of the seventh top face 710 and the boundary edges of the seventh bottom face 720 to one another. In the embodiment of the present disclosure, the seventh lateral face 730 extends from the boundary edges of the seventh top face 710 toward the seventh bottom face 720 and is thus connected to the boundary edges of the seventh bottom face 720. The seventh lateral face 730 surrounds the edges of the seventh space portion 705. The seventh bottom face 720 has the seventh height H7. The seventh height H7 is the same as the first height H1 and the sixth height H6.

The seventh lateral face 730 includes a first lateral region 731, a second lateral region 732, a third lateral region 733, and a fourth lateral region 734. The first lateral region 731 has the shape of an isosceles trapezoid. The first lateral region 731 has the seventh length L7. In the embodiment of the present disclosure, the seventh length L7 is the same as a distance between one end and the other end of the first lateral region 731. The seventh length L7 is the same as the first length L1.

One end of the first lateral region 731 is connected to one end of the second lateral region 732. The other end of the first lateral region 731 is connected to one end of the fourth lateral region 734. A height of the first lateral region 731 becomes higher toward the other end of the first lateral region 731 from one end thereof.

The second lateral region 732 has the shape of a rectangle. A length of the second lateral region 732 is $\sqrt{2}$ times longer than the seventh length L7. In the embodiment of the present disclosure, the length of the second lateral region 732 is a distance between one end and the other end of the second lateral region 732. One end of the second lateral region 732 is connected to one end of the first lateral region 731. The other end of the second lateral region 732 is connected to one end of the third lateral region 733. A height of the second lateral region 732 is constant.

The third lateral region 733 has the shape of an isosceles trapezoid. A length of the third lateral region 733 is the same as the seventh length L7. In the embodiment of the present disclosure, the length of the third lateral region 733 is a distance between one end and the other end of the third lateral region 733. One end of the third lateral region 733 is connected to the other end of the second lateral region 732. The other end of the third lateral region 733 is connected to the other end of the fourth lateral region 734. A height of the third lateral region 733 becomes lower toward the other end of the third lateral region 733 from one end thereof.

The fourth lateral region 734 has the shape of a rectangle. A length of the fourth lateral region 734 is $\sqrt{2}$ times longer than the seventh length L7. In the embodiment of the present disclosure, the length of the fourth lateral region 734 is a distance between one end and the other end of the fourth lateral region 734. One end of the fourth lateral region 734 is connected to the other end of the first lateral region 731. The other end of the fourth lateral region 734 is connected to the other end of the third lateral region 733. A height of the fourth lateral region 734 is constant. The height of the fourth lateral region 734 is the same as of the third lateral region 133 of the first lateral face 130.

The seventh height H7 of the seventh top face 710 and the seventh height H7 of the seventh bottom face 720 are distances calculated by multiplying a value obtained by subtracting the height of the other end of the third lateral region 733 from the height of the other end of the first lateral region 731 by 0.5.

The seventh space portion 705 is located inside the seventh 3D block 700. The seventh space portion 705 is surrounded with the seventh top face 710, the seventh bottom face 720, and the seventh lateral face 730. In an embodiment of the present disclosure, the seventh space portion 705 is empty. In another embodiment of the present disclosure, unlike this, the seventh space portion 705 is filled with a shock absorbing material.

The seventh accommodation pipes 740 are located inside the seventh lateral face 730. That is, the seventh accommodation pipes 740 are located inside the seventh space portion 705. The seventh accommodation pipes 740 are located on the underside of the seventh lateral face 730. The seventh accommodation pipes 740 are arranged along the seventh lateral face 730. In the embodiment of the present disclosure, the seventh accommodation pipes 740 are located on the undersides of the first lateral region 731, the second lateral region 732, the third lateral region 733, and the fourth lateral region 734.

One of the seventh accommodation pipes 740 is located at a region where the first lateral region 731 and the second lateral region 732 are connected to each other. One of the seventh accommodation pipes 740 is located at a region where the third lateral region 733 and the fourth lateral region 734 are connected to each other. The seventh accommodation pipes 740 are spaced apart from one another. The seventh accommodation pipes 740 are located long in a direction vertical with respect to the direction of the seventh length L7 or in height directions thereof.

The seventh partition pipes 745 are located inside the seventh lateral face 730. That is, the seventh partition pipes 745 are located inside the seventh space portion 705. The seventh partition pipes 745 are located on the underside of the seventh lateral face 730. The seventh partition pipes 745 are arranged along the seventh lateral face 730. In the embodiment of the present disclosure, one of the seventh partition pipes 745 is located at a region where the first lateral region 731 and the fourth lateral region 734 are connected to each other. Further, one of the seventh partition pipes 745 is located at a region where the second lateral region 732 and the third lateral region 733 are connected to each other.

The seventh partition pipes 745 are located long in a direction vertical with respect to the direction of the seventh length L7 or in height directions thereof. The seventh partition pipes 745 are spaced apart from one another. Each seventh partition pipe 745 is located between the neighboring seventh accommodation pipes 740. The seventh partition pipes 745 have spaces formed therein.

The magnetic members include seventh magnetic members 750. The seventh magnetic members 750 are located inside the seventh accommodation pipes 740. In the embodiment of the present disclosure, one (hereinafter, referred to as a first magnetic member) of the seventh magnetic members 750 is located inside the seventh accommodation pipe 740 located at a region where the first lateral region 731 and the second lateral region 732 are connected to each other. A pair of magnetic members of the seventh magnetic members 750 is located adjacent to the first magnetic member of the seventh magnetic members 750. The pair of magnetic members 750 located adjacent to the first magnetic member of the seventh magnetic members 750 has the same distance from the first magnetic member.

In the embodiment of the present disclosure, one (hereinafter, referred to as a second magnetic member) of the seventh magnetic members 750 is located inside the seventh accommodation pipe 740 located at a region where the third lateral region 733 and the fourth lateral region 734 are connected to each other. A pair of magnetic members of the seventh magnetic members 750 is located adjacent to the second magnetic member of the seventh magnetic members 750. The pair of magnetic members 750 located adjacent to the second magnetic member of the seventh magnetic members 750 has the same distance from the second magnetic member.

The seventh magnetic members 750 are located long along the longitudinal directions of the seventh accommodation pipes 740. The seventh magnetic members 750 are located long in a direction vertical with respect to the direction of the seventh length L7 or in height directions thereof.

The seventh magnetic members 750 located inside the seventh accommodation pipes 740 move with respect to the longitudinal directions thereof. Accordingly, when the seventh magnetic members 750 are adjacent to other magnetic members, they easily move to allow different magnetic forces from the magnetic forces of other magnetic members to be attracted to other magnetic members.

The seventh magnetic members 750 are restricted in the movements in the longitudinal directions by means of seventh stopper members located inside the seventh accommodation pipes 740. The seventh stopper members are located on one end and the other end of each seventh magnetic member 750.

Under the above-mentioned configuration, now, an explanation of a method for using the pickagram as the three-dimensional puzzle according to the present disclosure will be given below.

Figure 18:
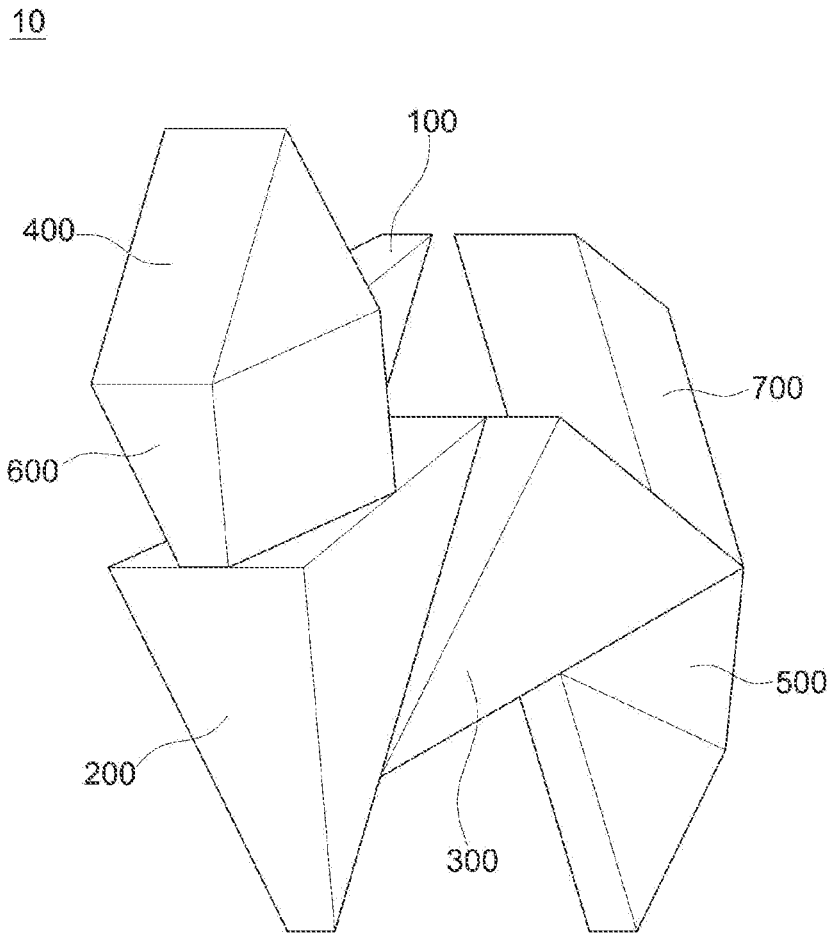
FIG. 18 is a perspective view showing a given figure obtained by combining the 3D blocks of the pickagram three-dimensional puzzle of FIG. 1.

FIG. 18 is a perspective view showing a given figure obtained by combining the 3D blocks of the pickagram as the three-dimensional puzzle of FIG. 1.

Referring to FIGS. 1 to 18, the pickagram 10 as the three-dimensional puzzle according to the embodiment of the present disclosure includes the first to seventh 3D blocks 100 to 700. The first to seventh 3D blocks 100 to 700 are coupled to one another by means of the magnetic forces.

For example, the first lateral face 130 is attached to at least any one of the second to seventh lateral faces 230 to 730 by means of the magnetic forces. The second lateral face 230 is attached to at least any one of the first lateral face 130 and the third to seventh lateral faces 330 to 730 by means of the magnetic forces. The third lateral face 330 is attached to at least any one of the first lateral face 130, the second lateral face 230, and the fourth to seventh lateral faces 430 to 730 by means of the magnetic forces. The fourth lateral face 430 is attached to at least any one of the first to third lateral faces 130 to 330 and the fifth to seventh lateral faces 530 to 730 by means of the magnetic forces. The fifth lateral face 530 is attached to at least any one of the first to fourth lateral faces 130 to 430, the sixth lateral face 630, and the seventh lateral face 730 by means of the magnetic forces. The sixth lateral face 630 is attached to at least any one of the first to fifth lateral faces 130 to 530 and the seventh lateral face 730 by means of the magnetic forces. The seventh lateral face 730 is attached to at least any one of the first to sixth lateral faces 130 to 630 by means of the magnetic forces. Accordingly, the user couples the first to seventh 3D blocks 100 to 700 to one another to create various 3D figures.

In the embodiment of the present disclosure, the first lateral face 130 of the first 3D block 100 is coupled to the sixth lateral face 630 of the sixth 3D block 600 by means of the magnetic forces. For example, the second lateral region 132 of the first lateral face 130 is coupled to the third lateral region 633 of the sixth lateral face 630 by means of the magnetic forces. In this case, the first 3D block 100 is coupled to the sixth 3D block 600 in such a way as to allow the first lateral region 131 to face upward.

The sixth lateral face 630 of the sixth 3D block 600 is coupled to the first lateral face 130 of the first 3D block 100, the fourth lateral face 430 of the fourth 3D block 400, and the second lateral face 230 of the second 3D block 200 by means of the magnetic forces. In the embodiment of the present disclosure, the third lateral region 633 of the sixth lateral face 630 is coupled to the second lateral region 132 of the first lateral face 130 by means of the magnetic forces. The fourth lateral region 634 of the sixth lateral face 630 is coupled to the first lateral region 431 of the fourth lateral face 430 by means of the magnetic forces. The second lateral region 632 of the sixth lateral face 630 is coupled to the first lateral region 231 of the second lateral face 230 by means of the magnetic forces.

The fourth lateral face 430 of the fourth 3D block 400 is coupled to the sixth lateral face 630 of the sixth 3D block 600 by means of the magnetic forces. In the embodiment of the present disclosure, the first lateral region 431 of the fourth lateral face 430 is coupled to the fourth lateral region 634 of the sixth lateral face 630 by means of the magnetic forces. The second lateral region 432 of the fourth lateral face 430 is located on the same plane as the third lateral region 633 of the sixth lateral face 630.

The second lateral face 230 of the second 3D block 200 is coupled to the sixth lateral face 630 of the sixth 3D block 600 and the third lateral face 330 of the third 3D block 300 by means of the magnetic forces. In the embodiment of the present disclosure, the first lateral region 231 of the second lateral face 230 is coupled to the second lateral region 632 of the sixth lateral face 630 by means of the magnetic forces. The third lateral region 233 of the second lateral face 230 is coupled to the first lateral region 331 of the third lateral face 330 by means of the magnetic forces.

The third lateral face 330 of the third 3D block 300 is coupled to the second lateral face 230 of the second 3D block 200, the fifth lateral face 530 of the fifth 3D block 500, and the seventh lateral face 730 of the seventh 3D block 700 by means of the magnetic forces. In the embodiment of the present disclosure, the first lateral region 331 of the third lateral face 330 is coupled to the third lateral region 233 of the second lateral face 230 by means of the magnetic forces. The second lateral region 332 of the third lateral face 330 is coupled to the third lateral region 733 of the seventh lateral face 730 by means of the magnetic forces. The third lateral region 333 of the third lateral face 330 is coupled to the second lateral region 532 of the fifth lateral face 530 by means of the magnetic forces.

The fifth lateral face 530 of the fifth 3D block 500 is coupled to the third lateral face 330 of the third 3D block 300 by means of the magnetic forces. In the embodiment of the present disclosure, the second lateral region 532 of the fifth lateral face 530 is coupled to the third lateral region 333 of the third lateral face 330 by means of the magnetic forces.

The seventh lateral face 730 of the seventh 3D block 700 is coupled to the third lateral face 330 of the third 3D block 300 by means of the magnetic forces. In the embodiment of the present disclosure, the third lateral region 733 of the seventh lateral face 730 is coupled to the second lateral region 332 of the third lateral face 330 by means of the magnetic forces.

In the embodiment of the present disclosure, the first to seventh 3D blocks 100 to 700 are coupled to one another by means of the magnetic forces to create a dog-like figure, but the 3D figure that can be created by the pickagram 10 as the three-dimensional puzzle may not be limited thereto.

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above teachings. It is therefore intended that the scope of the disclosure be limited not by this detailed description, but rather by the claims appended hereto.

| Explanations of Reference Numeralsin the Drawings | |
|---|---|
| 10: Pickagram three-dimensional puzzle | 300: Third 3D block |
| 100: First 3D block | 500: Fifth 3D block |
| 200: Second 3D block | |
| 400: Fourth 3D block | |
| 600: Sixth 3D block | |

What is claimed is:

1. A pickagram three-dimensional puzzle comprising seven three-dimensional (3D) blocks and a plurality of magnetic members located inside each 3D block to couple neighboring 3D blocks to one another through magnetic forces generated therefrom wherein a first 3D block of the seven 3D blocks has a shape of an isosceles right triangle on a plane, the first 3D block comprises:

a first top face;

a first bottom face located to be opposite to the first top face;

a first lateral face connecting boundary edges of the first top face and boundary edges of the first bottom face to one another, the first lateral face including a first lateral region, a second lateral region and a third lateral region, wherein the first lateral region is connected to the second lateral region and the third second lateral region, the second lateral region is connected to the first lateral region and the third lateral region and the third lateral region is connected to the first lateral region and the second lateral region; and a plurality of accommodation pipes arranged along the first lateral face inside the first lateral face, the plurality of accommodation pipes includes a first accommodation pipe located where the first lateral region is connected to the third lateral region, a second accommodation pipe located where the second lateral region is connected to the third lateral region, and a third accommodation pipe is located between the first accommodation pipe and the second accommodation pipe along the third lateral region, a fourth accommodation pipe, and a fifth accommodation pipe that is located in the second lateral region between the second accommodation pipe and the location where the first lateral region is connected to the second lateral region, and the plurality of magnetic members comprising a plurality of first magnetic members located correspondingly inside the plurality of accommodation pipes, wherein a distance between the first accommodation pipe and the third accommodation pipe is the same as a distance between the first accommodation pipe and the fourth accommodation pipe, wherein a distance between the second accommodation pipe and the third accommodation pipe is the same as a distance between the second accommodation pipe and the fifth accommodation pipe, and wherein the first lateral region includes a length between ends and each of the first accommodation pipe, the second accommodation pipe, and the third accommodation pipe include a first pipe length in a direction transverse to the length between ends of the first lateral region that is the same and wherein at least one or both the fourth accommodation pipe and the fifth accommodation pipe is longer than the first pipe length.

2. The pickagram three-dimensional puzzle according to claim 1, wherein the first lateral face comprises:

a first lateral region having a first length and a shape of an isosceles trapezoid;

a second lateral region having the first length and a shape of an isosceles trapezoid and extending vertically from one end of the first lateral region; and a third lateral region having a shape of a rectangle and connecting the other end of the first lateral region and the other end of the second lateral region to each other.

3. The pickagram three-dimensional puzzle according to claim 2, wherein the plurality of accommodation pipes extend in a vertical direction with respect to a direction of the first length in such a way as to be arranged along the first lateral face inside the first lateral face.

4. The pickagram three-dimensional puzzle according to claim 3, wherein the first 3D block further comprises a plurality of first partition pipes located inside the first lateral face, each of the plurality of first partition pipes being located between the plurality of accommodation pipes adjacent to each other.

5. The pickagram three-dimensional puzzle according to claim 1, wherein the first magnetic members extend in the longitudinal directions of the first accommodation pipes and move inside the first accommodation pipes in a longitudinal direction of each of the first magnetic members.

6. The pickagram three-dimensional puzzle according to claim 1, wherein a second 3D block of the seven 3D blocks has a shape of an isosceles right triangle on a plane, the second 3D block comprises:

a second top face;

a second bottom face located to be opposite to the second top face;

a second lateral face for connecting boundary edges of the second top face and boundary edges of the second bottom face to one another; and a plurality of second accommodation pipes arranged along the second lateral face inside the second lateral face, and the plurality of magnetic members comprising a plurality of second magnetic members located correspondingly inside the plurality of second accommodation pipes.

7. A pickagram three-dimensional puzzle comprising at least two three-dimensional (3D) blocks and a plurality of magnetic members to couple the at least two 3D blocks to one another through magnetic forces generated, each of the at least two 3D blocks comprising:

a top face;

a bottom face located opposite to the top face;

a lateral face connecting boundary edges of the top face and boundary edges of the bottom face to one another, the lateral face including a first lateral region, a second lateral region and a third lateral region, wherein the first lateral region is connected to the second lateral region and the third second lateral region, the second lateral region is connected to the first lateral region and the third lateral region and the third lateral region is connected to the first lateral region and the second lateral region; and a plurality of accommodation pipes arranged along the lateral face inside the lateral face, the plurality of accommodation pipes includes a first accommodation pipe located where the first lateral region is connected to the third lateral region, a second accommodation pipe located where the second lateral region is connected to the third lateral region, and a third accommodation pipe is located between the first accommodation pipe and the second accommodation pipe along the third lateral region, and the plurality of magnetic members located correspondingly inside the plurality of accommodation pipes;

wherein the first lateral region comprises a first length and a shape of an isosceles trapezoid, the second lateral region comprises the first length and a shape of an isosceles trapezoid and extending vertically from one end of the first lateral region, and the a third lateral region having a shape of a rectangle and connecting the other end of the first lateral region and the other end of the second lateral region to each other, the plurality of accommodation pipes further comprises a fourth accommodation pipe and a fifth accommodation pipe that is located in the second lateral region between the second accommodation pipe and the location where the first lateral region is connected to the second lateral region, wherein a distance between the first accommodation pipe and the third accommodation pipe is the same as a distance between the first accommodation pipe and the fourth accommodation pipe, and wherein the first lateral region includes a length between ends and each of the first accommodation pipe, the second accommodation pipe, and the third accommodation pipe include a first pipe length in a direction transverse to the length between ends of the first lateral region that is the same and wherein at least one or both the fourth accommodation pipe and the fifth accommodation pipe is longer than the first pipe length.

* * * * *